US012612850B2

(12) United States Patent
Liu et al.

(10) Patent No.: US 12,612,850 B2
(45) Date of Patent: Apr. 28, 2026

(54) SYSTEMS AND METHODS FOR REAL TIME DOWNHOLE MOTOR POWER CURVE GENERATION

(71) Applicant: Schlumberger Technology Corporation, Sugar Land, TX (US)

(72) Inventors: Bo Liu, Beijing (CN); Yan Song Huang, Beijing (CN); Ying Fu, Sugar Land, TX (US); Samba Ba, Houston, TX (US); Jing Ma, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 173 days.

(21) Appl. No.: 18/443,522

(22) Filed: Feb. 16, 2024

(65) Prior Publication Data

US 2025/0264012 A1 Aug. 21, 2025

(51) Int. Cl.
*E21B 44/00* (2006.01)
*E21B 4/02* (2006.01)

(52) U.S. Cl.
CPC ..... *E21B 44/00* (2013.01); *E21B 4/02* (2013.01)

(58) Field of Classification Search
CPC ..... E21B 44/00; E21B 4/02
See application file for complete search history.

(56) References Cited

U.S. PATENT DOCUMENTS

| | | | | | |
|---|---|---|---|---|---|
| 5,368,108 | A * | 11/1994 | Aldred | E21B 44/005 175/50 |
| 5,679,894 | A * | 10/1997 | Kruger | E21B 47/06 73/152.01 |
| 6,019,180 | A * | 2/2000 | Pafitis | E21B 44/00 175/48 |
| 9,574,432 | B2 | 2/2017 | Ringer | |
| 2023/0279769 | A1 | 9/2023 | Ba | |

* cited by examiner

*Primary Examiner* — D. Andrews
(74) *Attorney, Agent, or Firm* — Kyle R. Miiller

(57) ABSTRACT

A method of evaluating an operation of a downhole motor implemented in a wellbore includes receiving a first set of downhole data associated with the operation of the downhole motor at a first flowrate and generating a flowrate-independent power curve for the downhole motor based on the first set of downhole data. The method further includes, based on the flowrate-independent power curve, determining a second set of downhole data associated with the operation of the motor at a second flowrate.

20 Claims, 12 Drawing Sheets

SYSTEMS AND METHODS FOR REAL TIME DOWNHOLE MOTOR POWER CURVE GENERATION

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

In many cases, downhole motors or mud motors may be implemented in a wellbore in order to steer and/or drive the rotation of various downhole tools. The behavior or response of these downhole motors may be characterized by a motor power curve. However, the behavior of the downhole motor, and accordingly the motor power curve, may be influenced by many different factors such as properties of the downhole environment, the formation being encountered, the operational parameters of the drilling system, and the differential pressure and fluid flow rate through the motor, among other factors. Thus, techniques for determining a real time motor power curve that accurately reflects the behavior of the downhole motor in response to these different factors may be advantageous.

SUMMARY

In some embodiments, a method of evaluating an operation of a downhole motor implemented in a wellbore includes receiving a first set of downhole data associated with the operation of the downhole motor at a first flowrate and generating a flowrate-independent power curve for the downhole motor based on the first set of downhole data. The method further includes, based on the flowrate-independent power curve, determining a second set of downhole data associated with the operation of the motor at a second flowrate.

In some embodiments, a method of operating a downhole motor implemented in a wellbore includes receiving a first set of downhole data associated with an operation of the downhole motor at a first flowrate and generating a flow-rate independent power curve for the downhole motor based on the first set of downhole data. The method further includes causing one or more operational parameters of the downhole motor to be adjusted based on the flow-rate independent power curve.

In some embodiments, a method of evaluating an operation of a downhole motor implemented in a wellbore includes receiving a set of downhole data associated with the operation of the downhole motor, wherein the downhole data is associated with the operation of the downhole motor at a first plurality of different flowrates of the downhole motor. The method further includes generating a flowrate-independent power curve for the downhole motor based on the set of downhole data. The method further includes determining a flowrate-dependent power curve for the downhole motor based on the flowrate-independent power curve, wherein the flowrate-dependent power curve is associated with an operation of the downhole motor at a second flowrate that is not included in the first plurality of flowrates.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 4-1 illustrates an example torque power curve, according to at least one embodiment of the present disclosure;

FIG. 4-2 illustrates an example RPM power curve, according to at least one embodiment of the present disclosure;

FIG. 7-1 illustrates several example flowrate-dependent RPM power curves, according to at least one embodiment of the present disclosure;

FIG. 7-2 illustrates several example operational parameters for an operation of a downhole motor, according to at least one embodiment of the present disclosure;

DETAILED DESCRIPTION

Figure 1:
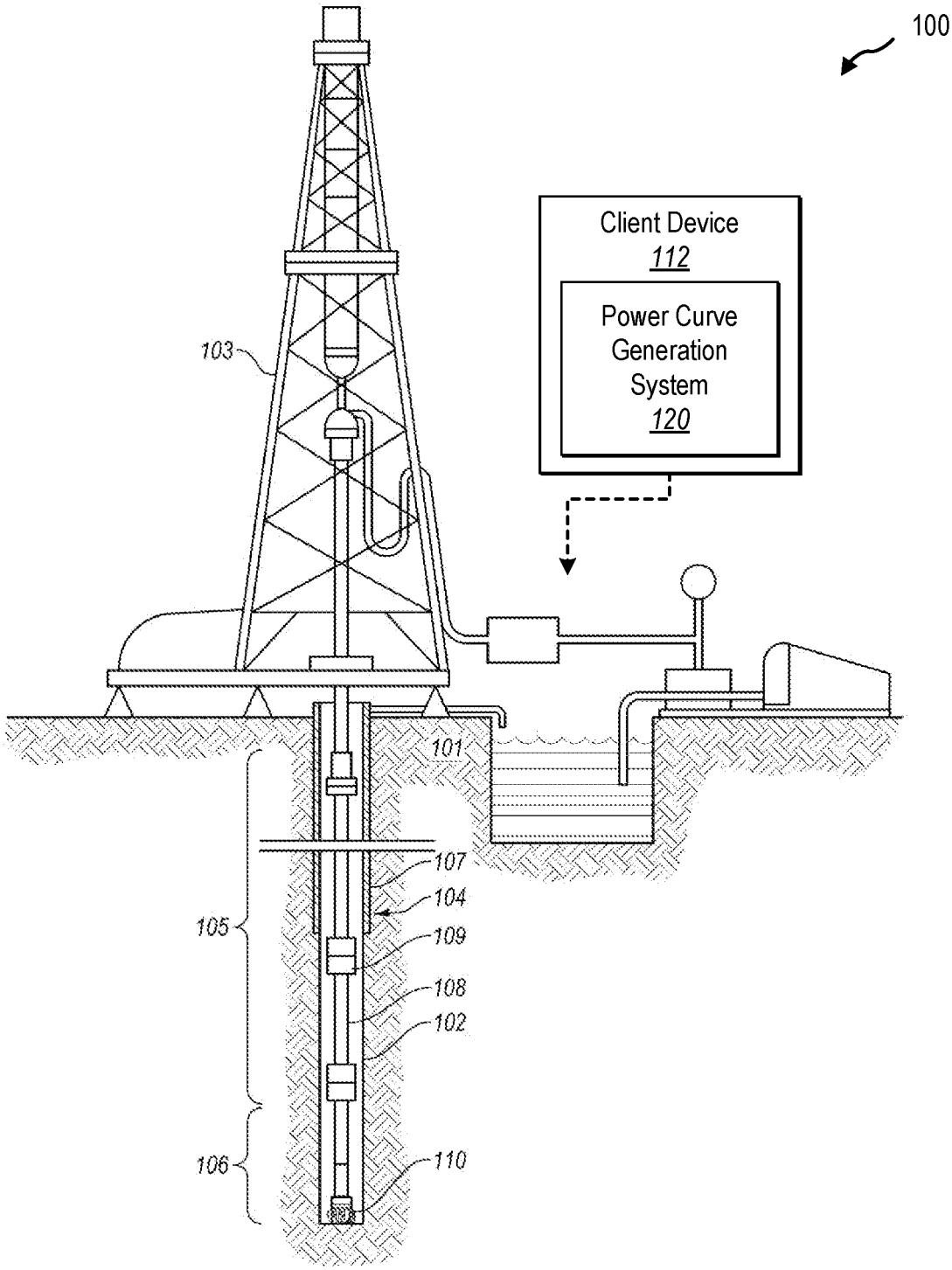
FIG. 1 is an example of a downhole system, according to at least one embodiment of the present disclosure.

This disclosure generally relates to systems and methods for generating power curves for a downhole motor. A computer implemented power curve generation system may receive downhole data for an operation of a downhole motor. The downhole data may indicate a rotational speed output of the downhole motor and/or a torque output of the downhole motor with respect to a differential fluid pressure across the downhole motor, among other data. The downhole data may indicate and/or may be associated with an operation of the downhole motor at one or more different flowrates. The power curve generation system may generate a flowrate-independent power curve by fitting a flowrate-independent power law model to the downhole data. In this way, the flowrate-independent power curve may characterize the expected behavior of the downhole motor at any flowrate of the downhole motor, even for flowrates for which downhole data is not available or known. In this manner, the flowrate-independent power curve may inform an efficient and effective operation of the downhole motor at any number of different flowrates, regardless of whether operation of the downhole motor has been measured or observed for a particular flowrate of interest.

As will be discussed in further detail below, the present disclosure includes a number of practical applications having features described herein that provide benefits and/or solve problems associated with characterizing the behavior of a downhole motor. Some example benefits are discussed herein in connection with various features and functionalities provided by a power curve generation system implemented on one or more computing devices. It will be appreciated that benefits explicitly discussed in connection with one or more embodiments described herein are provided by way of example and are not intended to be an exhaustive list of all possible benefits of the power curve generation system.

For example, power curves may be valuable tools for characterizing and understanding the expected behavior of a downhole motor. However, power curves may typically be provided, by a manufacturer for example, as a generic power curve that applies to all downhole motors of a particular variety and with respect to a general type of operation. Thus, these tool spec power curves may not particularly apply to a specific downhole motor, and most importantly, may not be attuned to the specific operating conditions that a downhole motor is subject to in a given downhole operation. The power curve generation system described herein, however, may generate one or more power curves for characterizing the expected motor behavior based on real input data that applies to a specific downhole motor, a specific operation of the downhole motor, and a specific set of circumstances affecting the downhole motor. In this way, the power curve generation system may provide a precise and accurate prediction of how the downhole motor will respond given the actual downhole conditions, including changes in downhole conditions.

Additionally, while other computer implemented techniques may similarly generate power curves and may similarly characterize motor behavior by accounting for various specific factors that affect the downhole motor, these techniques may often be slow, overly complicated and/or robust, and may be computationally expensive. For example, these techniques may require significant parameters as inputs in order to model and characterize many (or all) dynamics affecting the downhole motor. The power curve generation system, however, may implement a power law model that describes the behavior of the downhole motor based on simple and relatively few input parameters. By fitting this power law model to actual downhole RPM data for the downhole motor, the power curve generation system may quickly generate a power curve for the downhole motor that is based on the power law model, and accounts for and incorporates the various factors that affect downhole performance without specifically modeling those factors. In this way, the power curve generation system may provide current and updated power curves to predict the motor performance.

Indeed, the power curve generation system may generate and update the power curve in real time based on the real time acquisition of downhole data. In this way, changes in motor performance, be it due to changes in the downhole environment, changes in the motor, changes in the formation, etc., may be reflected in real time through updated power curves. This may help to better inform how to operate the downhole motor effectively and efficiently in order to achieve a desired result.

Further, the power curve generation system may determine one or more power curves that may be independent of a particular flowrate at which the downhole motor may operate. This may be in contrast to typical or conventional power curves, which may only be applicable to one specific flowrate. The flowrate-independent power curve in this way may accurately predict the expected motor behavior regardless of the flowrate at which the motor operates. Indeed, the flowrate-independent power curve may be applicable to flowrates for which no downhole data is available or know. In this way, a power curve may be generated based on downhole data for some flowrates, but may be applicable for predicting motor behavior for any flowrate.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional downhole drilling tools and/or components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110, other downhole drilling tools, or other components. An example BHA 106 may include additional or other downhole drilling tools or components (e.g., coupled between the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system 100 may include other downhole drilling tools, components, and accessories such as special valves (e.g., kelly cocks, blowout preventers, and safety valves). Additional components included in the downhole system 100 may be considered a part of the drilling tool assembly 104, the drill string 105, or a part of the BHA 106, depending on their locations in the downhole system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to the surface or may be allowed to fall downhole. The bit 110 may include one or more cutting elements for degrading the earth formation 101.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit 110, change the course of the bit 110, and direct the directional drilling tools on a projected trajectory. The RSS may steer the bit 110 in accordance with or based on a trajectory for the bit 110. For example, a trajectory may be determined for directing the bit 110 toward one or more subterranean targets such as an oil or gas reservoir.

The downhole system 100 may include or may be associated with one or more client devices 112 with a power curve generation system 120 implemented thereon (e.g., implemented on one, several, or across multiple client devices 112). The power curve generation system 120 may facilitate determining a power curve for characterizing and/or predicting the behavior of a downhole motor.

Figure 2:
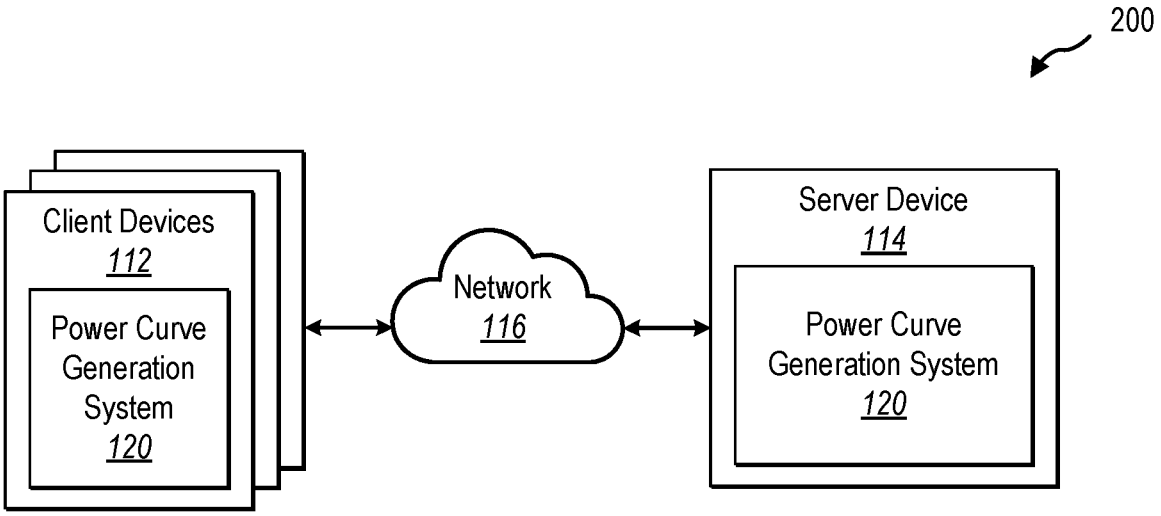
FIG. 2 illustrates an example environment in which a power curve generation system is implemented, according to at least one embodiment of the present disclosure.

FIG. 2 illustrates an example environment 200 in which a power curve generation system 120 is implemented in accordance with one or more embodiments described herein. As shown in FIG. 2, the environment 200 includes one or more server device(s) 114. The server device(s) 114 may include one or more computing devices (e.g., including processing units, data storage, etc.) organized in an architecture with various network interfaces for connecting to and providing data management and distribution across one or more client systems. As shown in FIG. 2, the server devices 114 may be connected to and may communicate with (either directly or indirectly) one or more client devices 112 through a network 116. The network 116 may include one or multiple networks and may use one or more communication platforms and/or technologies suitable for transmitting data. The network 116 may refer to any data link that enables transport of electronic data between devices of the environment 200. The network 116 may refer to a hardwired network, a wireless network, or a combination of a hardwired network and a wireless network. In one or more embodiments, the network 116 includes the internet. The network 116 may be configured to facilitate communication between the various computing devices via well-site information transfer standard markup language (WITSML) or similar protocol, or any other protocol or form of communication.

The client devices 112 may refer to various types of computing devices. For example, one or more client devices 112 may include a mobile device such as a mobile telephone, a smartphone, a personal digital assistant (PDA), a tablet, a laptop, or any other portable device. Additionally, or alternatively, the client devices 112 may include one or more non-mobile devices such as a desktop computer, server device, surface or downhole processor or computer (e.g., associated with a sensor, system, or function of the downhole system), or other non-portable device. In one or more implementations, the client devices 112 include graphical user interfaces (GUI) thereon (e.g., a screen of a mobile device). In addition, or as an alternative, one or more of the client devices 112 may be communicatively coupled (e.g., wired or wirelessly) to a display device having a graphical user interface thereon for providing a display of system content. The server device(s) 114 may similarly refer to various types of computing devices. Each of the devices of the environment 200 may include features and/or functionalities described below in connection with FIG. 11.

As shown in FIG. 2, the environment 200 may include a power curve generation system 120 implemented on one or more computing devices. The power curve generation system 120 may be implemented on one or more client device 112, server devices 114, and combinations thereof. Additionally, or alternatively, the power curve generation system 120 may be implemented across the client devices 112 and/or the server devices 114 such that different portions or components of the power curve generation system 120 are implemented on different computing devices in the environment 200. In this way, the environment 200 may be a cloud computing environment, and the power curve generation system 120 may be implemented across one or more devices of the cloud computing environment in order to leverage the processing capabilities, memory capabilities, connectivity, speed, etc., that such cloud computing environments offer in order to facilitate the features and functionalities described herein.

Figure 3:
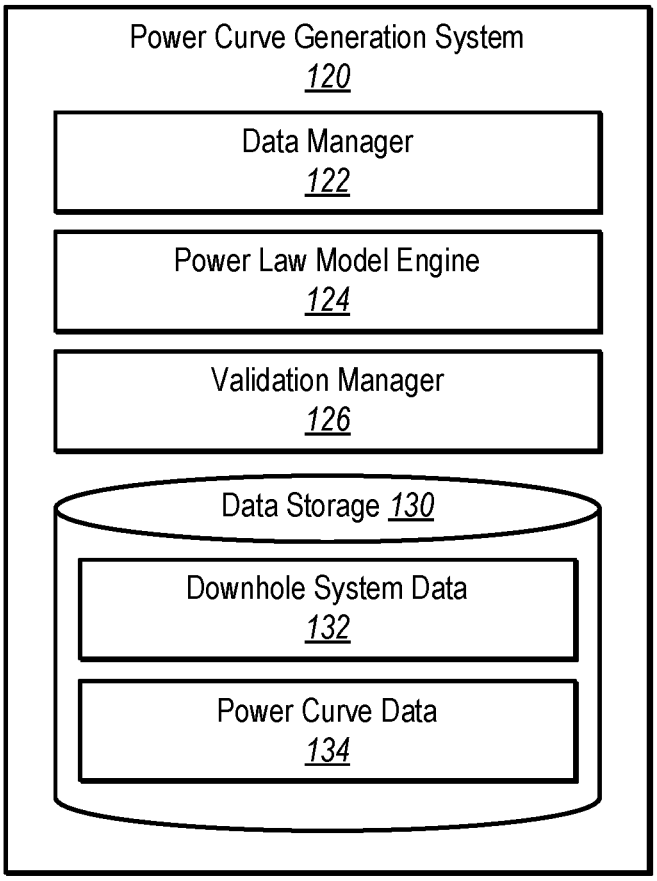
FIG. 3 illustrates an example implementation of a power curve generation system as described herein, according to at least one embodiment of the present disclosure.

FIG. 3 illustrates an example implementation of the power curve generation system 120 as described herein, according to at least one embodiment of the present disclosure. The power curve generation system 120 may include a data manager 122, a power law model engine 124, and a validation manager 126. The power curve generation system 120 may also include a data storage 130 having downhole system data 132 and power curve data 134 stored thereon. While one or more embodiments described herein describe features and functionalities performed by specific components 122-126 of the power curve generation system 120, it will be appreciated that specific features described in connection with one component of the power curve generation system 120 may, in some examples, be performed by one or more of the other components of the power curve generation system 120.

By way of example, one or more of the data receiving, gathering, or storing features of the data manager 122 may be delegated to other components of the power curve generation system 120. As another example, while validation of the power curves may be performed by the validation manager 126, in some instances, some or all of these features may be performed by the power law model engine 124 (or other component of the power curve generation system 120). Indeed, it will be appreciated that some or all of the specific components may be combined into other components and specific functions may be performed by one or across multiple components 122-126 of the power curve generation system 120.

Additionally, while FIG. 1, for example, depicts the power curve generation system 120 implemented on a client device 112 of the downhole system, it should be understood that some or all of the features and functionalities of the power curve generation system 120 may be implemented on or across multiple client devices 112 and/or server devices 114. For example, data may be input and/or received by the data manager 122 on a (e.g., local) client device, and one or more power curves may be generated on one or more of a remote, server, or cloud device. Indeed, it will be appreciated that some or all of the specific components 122-126 may be implemented on or across multiple client devices 112 and/or server devices 114, including individual functions of a specific component being performed across multiple devices.

As mentioned above, the power curve generation system 120 includes a data manager 122. The data manager 122 may receive a variety of types of data associated with the downhole system and may store the data to the data storage 130. The data manager 122 may receive the data from a variety of sources, such as from sensors, surveying tools, downhole tools, other (e.g., client) devices, libraries, databases, user input, etc.

In some embodiments, the data manager 122 receives downhole system data 132. The downhole system data 132 may include any data associated with the downhole system, such as measurements from one or more sensors, parameters of an operation of the downhole system, information about the downhole system, etc. The data manager 122 may store any of this information to the data storage 130 as downhole system data 132. The data manager 122 may receive the downhole system data in real time (e.g., periodically and/or continuously) in order to facilitate the real-time power curve generation techniques described herein.

In some embodiments, the downhole system data 132 includes information associated with a downhole motor or mud motor implemented in the wellbore. The downhole system data 132 may include RPM data, or data associated with a rotational speed of the downhole motor and/or the downhole system generally. For example, the RPM data may include surface RPM data related to a rotational speed of the downhole system at the surface of the wellbore. For example, the downhole system may rotate the drill string (including the downhole motor) from or at the surface and the surface RPM may indicate this rotational speed. The surface RPM data may be measured by one or more surface sensors. In another example, the RPM data may include downhole or motor RPM data related to a rotational speed with which the downhole motor is driven to rotate within the wellbore. The downhole RPM data may incorporate and/or take into account a surface RPM, or may be independent of an applied surface RPM. For example, a drilling fluid may be pumped through the downhole motor in order to drive a rotation of the motor within the wellbore. This may be in addition to the rotation of the entire drill string (including the downhole motor) from the surface, or the surface RPM. In some instances, the downhole RPM may indicate the rotation of the downhole motor with respect to the rotation (or lack thereof) of the drill string. In this way the downhole or motor RPM may indicate the isolated rotational speed of the motor. In some embodiments, the motor RPM is measured with one or more downhole sensors. In some embodiments, as described herein, the downhole or motor RPM may be predicted, calculated, or inferred based on a generated RPM power curve.

In some embodiments, the downhole system data 132 includes torque data associated with a torque output or exhibited by the downhole motor. For example, the downhole motor may rotate one or more downhole tools, such as a drill bit, and the downhole motor may accordingly impart a torque to the downhole tool in order to degrade the formation. The torque may be resultant from the drilling fluid pumped through the power section of the motor. The torque data may be measured or observed by one or more downhole sensors. In some embodiments, as described herein, the torque data may be predicted, calculated, or inferred based on a generated torque power curve.

In some embodiments, the downhole system data 132 includes drilling fluid data associated with the drilling fluid flowing to and/or through the downhole motor. For example, a volume, flowrate, pressure, etc., of the drilling fluid flowing through the motor may define the behavior or performance of the downhole motor, including the RPM and/or torque output. For instance, the torque and/or RPM output of the downhole motor may be characterized with respect to a differential pressure of the downhole motor. Similarly, the behavior (e.g., torque and/or RPM vs differential pressure) may be influenced or affected by the flowrate of the drilling fluid through the downhole motor. Thus, the drilling fluid data may indicate various metrics for the drilling fluid such as the differential pressure and flowrate in order to characterize the performance of the downhole motor and to facilitate the techniques described herein. The drilling fluid data may be received through measurements of one or more downhole sensors or measurement devices.

In some embodiments, the downhole system data 132 includes operational parameter data associated with parameters, settings, values, etc., of an operation of the downhole system. For example, the operational parameter data may indicate a weight on bit (WOB) and/or rate of penetration (ROP) of the downhole system. The WOB and/or ROP may be a value applied and/or measured at the surface, and/or may include one or more measurements taken within the wellbore.

In some embodiments, the data manager 122 receives specification and/or technical data associated with the downhole motor. For example, the data manager 122 may receive or access a tool specification for the downhole motor, for example, provided by a manufacturer of the downhole motor. The tool specification may include information about the design, features, and performance characteristics of the downhole motor. For example, as described herein, the tool specification may include RPM and/or torque power curves for the downhole motor. The tool specification may indicate one or more parameters or constants for the downhole motor and/or for a power curve of the downhole motor, such as a rotations per gallon (rpg) parameter for the downhole motor as described herein.

In some embodiments, the data manager 122 receives wellbore data associated with the wellbore, the formation, and or the downhole environment. The wellbore data may indicate a depth, location, orientation, trajectory, etc., of one or more portions (or all) of the wellbore. For example, the wellbore data may indicate at what measurement depth an operation of interest of the downhole motor took place. The wellbore data may indicate one or more properties of a formation, such as the type, composition, and properties of a formation associated with an operation of the downhole motor. The wellbore data may indicate one or more properties of the downhole environment, such as a downhole static pressure and/or temperature.

In some embodiments, the data manager 122 receives user input. The data manager 122 may receive the user input, for example, via any of the client devices 112 and/or server devices 114. Any of the data described herein may be input or augmented via the user input. For example, in some instances, some or all of the downhole system data 132 is received by the data manager 122 as user input. The user input may be received in association with one or more functions or features of the power curve generation system 120, such as part of validating the generated power curve(s), or any other feature described herein.

In some embodiments, the data manager 122 cleans some or all of the data of the data storage 130. For example, the data manager 122 may receive data in a variety of forms. The data manager 122 may profile the data to understand its structure, format, quality, etc. Based on the profiling, the data manager 122 may check for issues such as missing values, duplicate entries, outliers, inconsistent formats, etc. The data manager 122 may validate the data against one or more predefined rules and/or standards such as verifying that data is in an expected format or falls within an expected range. In some embodiments, the data manager 122 addresses any errors or inconsistencies. For example, the data manager 122 may remove incorrect, inconsistent, or duplicate entries. In another example, the data manager may correct incorrect, inconsistent, or missing entries, such as by estimating or averaging values based on an associated context. In another example, the data manager 122 may standardize the format or transform the format of the data for consistency. In another example, the data manager 122 may flag data issues for manual review and/or may facilitate a user correcting data issues. In this way, the data manager 122 may facilitate identifying and/or correcting errors, inconsistencies, or inaccuracies in the data to make the data more reliable and useful.

As mentioned above, in some embodiments, some of the data may be associated with specific flow rates of the drilling fluid through the downhole motor. For example, the data manager 122 may receive torque data, RPM data, and differential pressure data associated with an operation of the downhole motor at one or more specific flow rates. As described herein, the power curve generation system 120 may generate a flowrate-independent RPM power curve for the downhole motor based on the downhole system data 132. In some embodiments, the data manager 122 may aggregate or combine some or all of the downhole system data 132 from its specific flow rate to an aggregation of downhole data that is independent or irrespective of flowrate. For example, the data storage 130 may take the data received for an operation of the downhole motor at various different flowrates and may combine the data into an aggregated data set of data from all of the various different flowrates. This flowrate-independent aggregation of data may facilitate generating the flowrate-independent RPM power curve as described herein. In some embodiments, the data manager 122 may modify some or all of the RPM data to generate flowrate-independent RPM data. For example, the data manager 122 may divide a value or measurement of the RPM data by the flowrate at which it was taken. For instance, the RPM data may include a measurement of rotational speed at a corresponding differential pressure. The data manager 122 may divide the rotational speed and/or differential pressure values by the corresponding flowrate to generate flowrate-independent values for these measurements. In this way, the data manager 122 may generate flowrate-independent RPM data that is generalized to all (or any possible) flowrate of the downhole motor.

In some embodiments, the behavior, performance, or output of a downhole motor may be characterized and/or defined by one or more power curves. For example, a power curve may characterize an output torque with respect to a differential fluid pressure across the power section (e.g., rotor and stator) of the downhole motor. In another example, a power curve may characterize an RPM of the downhole motor with respect to the differential fluid pressure. In many cases, it is important to understand what differential pressures will achieve desired RPM and torque outputs of the motor. For example, a given application or operation may have an optimal or desirable RPM and/or torque range for operating the downhole motor efficiently and effectively. For instance, too much torque could damage the downhole motor and/or an associated downhole tool. Too much or too little torque could be ineffective or inefficient. Further, downhole motors may experience fatigue and/or wear if operated in certain windows for extended periods of time. Thus, a power curve may facilitate a downhole operation by informing how, and with what operational parameters to operate the downhole motor in order to achieve a desired outcome. For example, adjusting the WOB may influence the differential pressure exhibited across the downhole motor, which may in turn affect the torque and/or RPM output by the downhole motor. This motor response may change and/or may be dependent on a particular flow rate of the fluid through the downhole motor. These operational parameters may be determined based on understanding how the motor will respond in a given application, which can be learned from a power curve.

In many cases a downhole motor may be provided with a tool specification that may include one or more power curves for the motor. While these power curves may be useful, in many cases they may not be precise, accurate, and/or may not reflect the real-world and/or changing conditions that the downhole motor is subject to. For example, tool spec power curves may be generic to all of the downhole motors of a specific type or variety of a given manufacturer. Thus, variations (e.g., from manufacture, assembly, use, etc.) from one downhole motor to the next may not be reflected in a generic tool spec power curve. Additionally, as described above, motor performance may be affected by any of a variety of factors associated with a specific implementation or use of the downhole motor. A generic tool spec power curve may be applicable to a general application or use of the downhole motor and may accordingly not be attuned to the specific operational conditions and operational parameters of a given operation of the downhole motor. Thus, while a tool spec power curve may be beneficial in some regards and/or may get close to characterizing motor behavior, in some cases these generic power curves may not reflect the motor performance with sufficient accuracy.

Figures 1, 4:
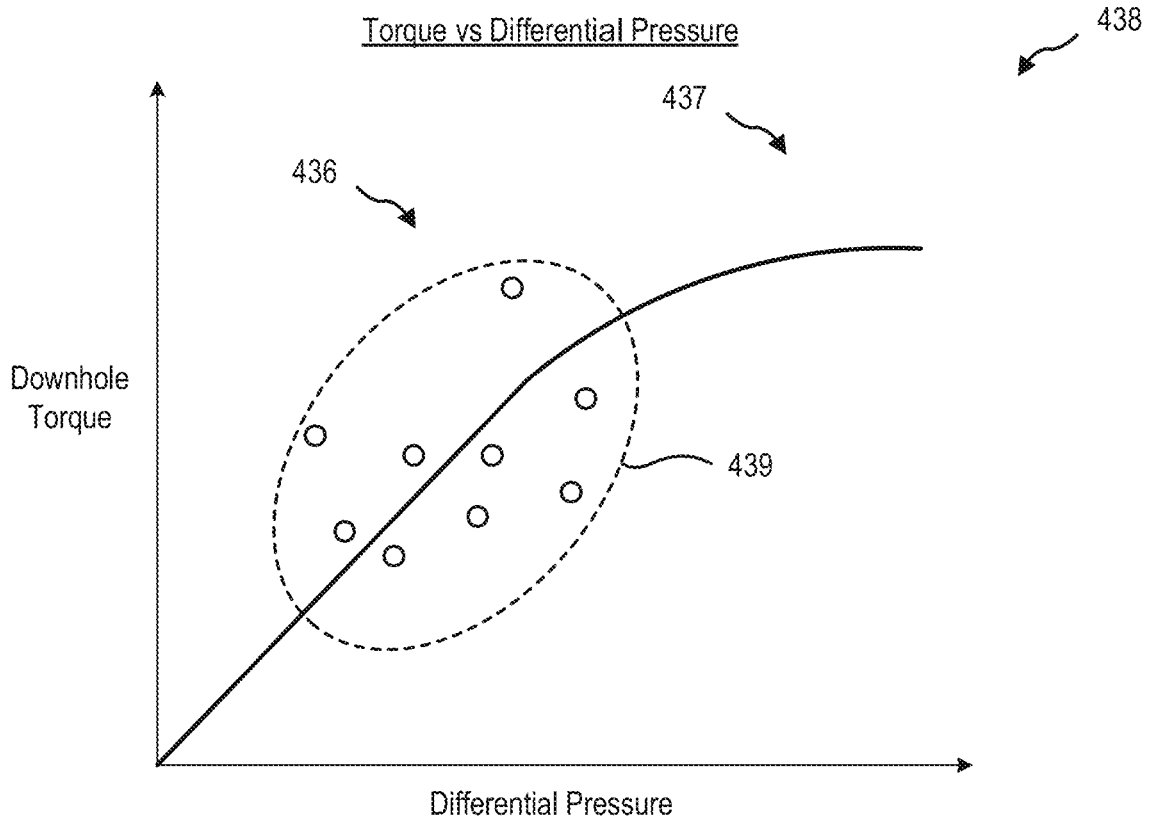
Figures 2, 4:
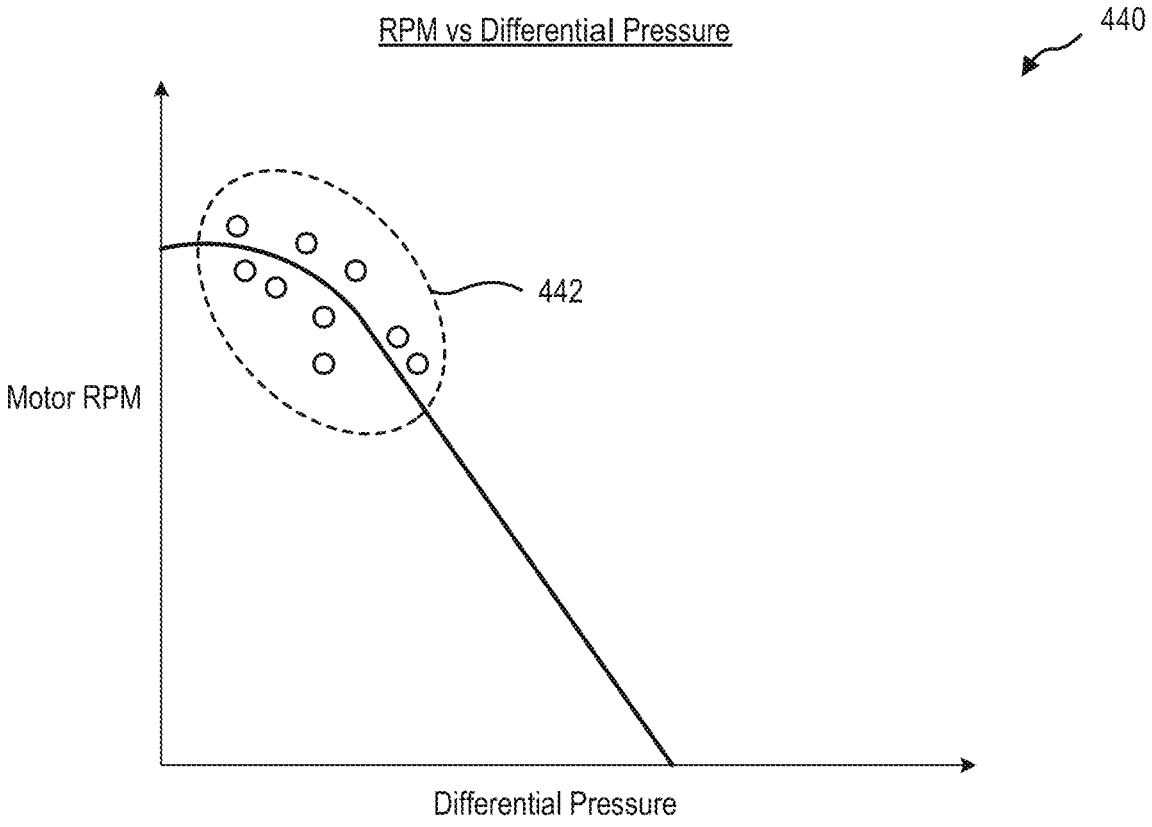

As mentioned above, the power curve generation system 120 includes a power law model engine 124. The power law model engine 124 may facilitate generating one or more power curves specific to the downhole motor, and to a specific application of the downhole motor. For example, the power curve generation system 120 may generate one or more power curves, such as a torque power curve and/or an RPM power curve based on the downhole system data 132 taken during an operation of the motor. FIG. 4-1 illustrates an example torque power curve 438 generated by the power law model engine 124 and FIG. 4-2 illustrates an example RPM power curve 440 generated by the power law model engine 124, according to embodiments of the present disclosure.

In some embodiments, the motor performance may be characterized by a power law model. The power law model may relate outputs of the downhole motor, such as torque and RPM, to various model parameters represented by coefficients or constants. For example, the power law model may describe the torque output of the downhole motor according to the following formula:

$$T = \beta \Delta P_a - \gamma \Delta P_a^2$$

Where:

T is the downhole torque;

$\Delta P_a$ is the total active differential pressure across the motor power section;

$\beta$ is a positive coefficient; and $\gamma$ is a positive coefficient, where $\beta >> \gamma$.

The torque power curve 438 of FIG. 4-1 may be based on this power law model (e.g., equation) for the torque output of the motor. As shown, the torque power curve 438 may be substantially linear, or may include a substantially linear region 436. For example, the downhole motor may have a working range of differential pressure defined as $\Delta P_{limit}$. When the motor is within the working range of the differential pressure, or when $\Delta P_a < \Delta P_{limit}$, then $\gamma=0$, as reflected in the linear region 436 of the torque power curve 438. $\beta$ is represented as the torque flow, or a positive coefficient that relates the changes in differential pressure to the torque output of the downhole motor. In some embodiments, the torque power curve 438 may have a curved region 437 or a region of decay that is not substantially linear. For example, if the differential pressure exceeds the working range, or if $\Delta P_a \geq \Delta P_{limit}$, then the motor may begin to operate less efficiently, and increases in the differential pressure may not equate to proportionate increased in torque output. $\gamma$ is represented as a positive coefficient to reflect the inefficiencies in the motor to convert the energy of the fluid pressure into torque at these elevated differential pressures.

In some embodiments, the power law model engine 124 may generate the torque power curve 438 based on fitting the power law model (e.g., torque equation) for the torque to a set of torque data 439. As described above, the torque data 439 may be data taken during an operation of the downhole motor and may be taken in real time. In some embodiments, the power law model engine 124 may generate and/or update the torque power curve 438 in real time based on the real time torque data 439. In this way, the torque power curve 438 fitted to the torque data 439 may characterize how the downhole motor is responding and/or behaving during an actual operation of the downhole motor and with respect to the actual downhole conditions of the specific application. This may be beneficial for informing how to operate and/or adjust the downhole motor in order to achieve a desired torque output, as the torque power curve 438 may incorporate and/or account for a variety of factors that may affect (and/or are presently affecting) the performance of the downhole motor as described herein. In this way, the torque power curve 438 may predict with an increased accuracy the response of the downhole motor, for example, over that of a generic or tool spec power curve.

As described herein, in some embodiments, the torque data 439 is data associated with a specific flowrate of the drilling fluid through the downhole motor. Thus, a torque power curve generated by the power law model engine 124 in this way may be applicable to, or may be associated with, the specific flowrate at which the associated torque data was taken. As described herein, in some embodiments the power law model engine 124 may generate a flowrate-independent RPM power curve for informing the operation of the downhole motor independent of the flowrate. Unlike the RPM, however, in some embodiments, the torque power curve 438 may not vary significantly with different flowrates. For example, a torque power curve may be substantially similar for different torque data taken at different flowrates to the that of the torque data 439. In this way, a torque power curve may be generated which may be applicable and useful for facilitating the operation of the downhole motor at any number of flowrates.

In some embodiments, the power law model may characterize the rotational speed output (RPM) of the downhole motor. For example, the power law model may describe the motor RPM according on the following formula:

$$RPM_m(Q) = RPM_0(Q)\left(1 - (\propto(Q)\Delta P_a)^k\right)$$

Where:

Q is the flowrate;

$RPM_m(Q)$ is the motor rotational speed at the flowrate Q;

$RPM_0(Q)=rpg \times Q$ is the reference motor rotational speed at Q;

rpg is the volumetric motor rotational output under a no load condition;

$\propto(Q)$ is the inverse of the stall pressure at the flowrate Q;

$\Delta P_a$ is the total active differential pressure across the motor; and

K is the slip factor of the motor.

The RPM power curve 440 of FIG. 4-2 may be based on the power law model (e.g., RPM equation) for the RPM output of the motor. The power law model engine 124 may generate the RPM power curve 440 based on fitting the power law model for the RPM to a set of RPM data 442. As described above, the RPM data 442 may be data taken during an operation of the downhole motor and may be taken in real time. In some embodiments, the power law model engine 124 may generate and/or update the RPM power curve 440 in real time based on the real time RPM data 442. In this way, the RPM power curve 440 fitted to the RPM data 442 may characterize how the downhole motor is responding and/or behaving during an actual operation of the downhole motor and with respect to the actual downhole conditions of the specific application. This may be beneficial for informing how to operate and/or adjust the downhole motor in order to achieve a desired RPM output, as the RPM power curve 440 may incorporate and/or account for a variety of factors that may (and/or are presently affecting) the performance of the downhole motor as described herein. In this way, the RPM power curve 440 may predict with an increased accuracy the response of the downhole motor, for example, over that of a generic or tool spec power curve.

As described herein, the RPM data 442 may be associated with a specific flowrate of the drilling fluid through the downhole motor. Thus, the RPM power curve 440 may be applicable to, or may be associated with, the specific flowrate at which associated RPM data 442 was taken. Thus, the RPM power curve 440 may be a flowrate-dependent RPM power curve (and the power law model described with respect to FIGS. 4-1 and 4-2 may be a flowrate-dependent power law model). Accordingly, the benefits of the RPM power curve 440 may be limited in their applicability to operations of the downhole motor at the same (or possibly similar) flow rates of the downhole motor. For example, the downhole motor may perform differently under different flow rates, and the RPM power curve 440 may not accurately represent the motor response under these different flow rates. Thus, the benefits of informing how to efficiently and effectively operate a downhole motor according to an RPM power curve in this way may be limited by the number of RPM power curves that can be generated for specific operating flowrates of the downhole motor. In other words, for flowrates with which an RPM power curve is not available or cannot be generated, the behavior of the downhole motor may not be accurately predicted (e.g., for flowrates with which an insufficient quantity of RPM data is available).

Figure 5:
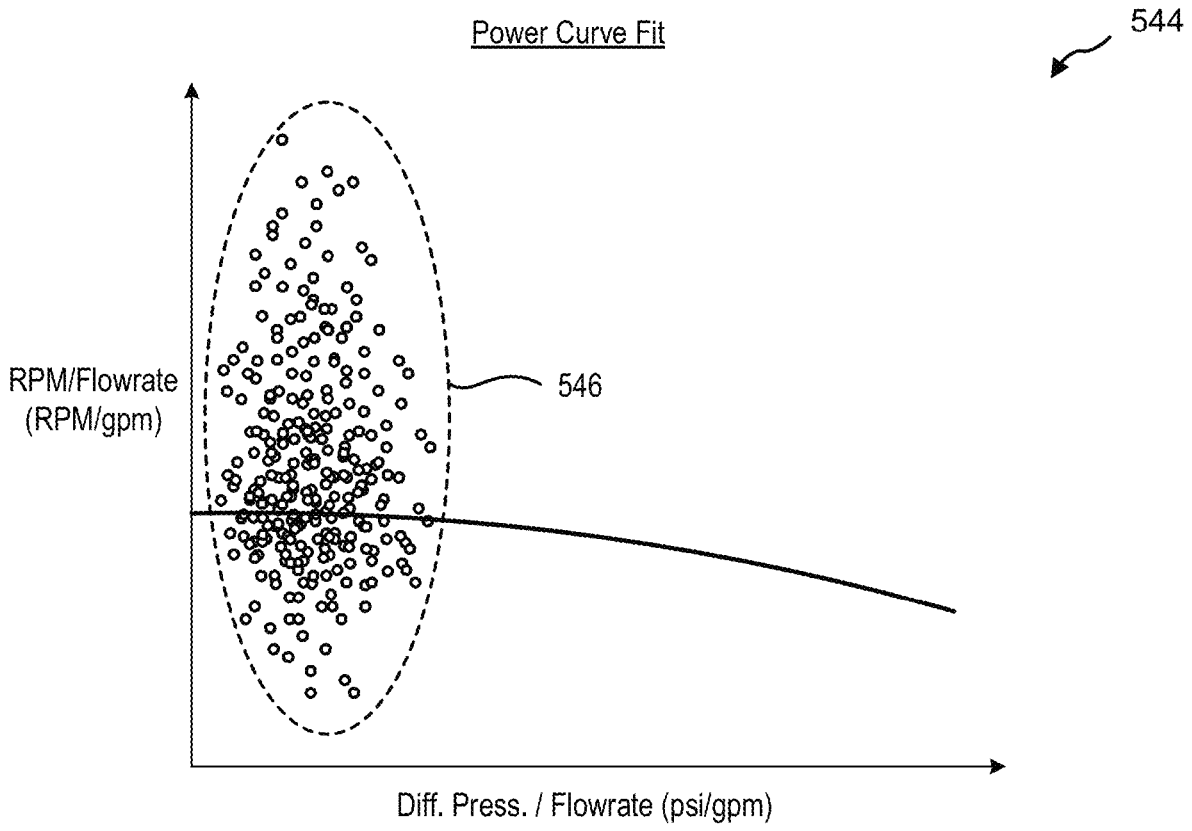
FIG. 5 illustrates an example flowrate-independent RPM power curve, according to at least one embodiment of the present disclosure.

In some embodiments, the power law model engine 124 generates a flowrate-independent RPM power curve for describing the downhole motor response independent of the particular flowrate with which the motor may operate. FIG. 5 illustrates an example flowrate-independent RPM power curve 544 according to at least one embodiment of the present disclosure.

In some embodiments, a flowrate-independent power law model may be implemented to characterize the flow-rate independent behavior of the downhole motor. For example, the flowrate-independent power law model may describe the RPM output of the motor with respect to the differential pressure in a way that generalized to all (or any possible) flowrate. The flowrate-independent power law model may be derived from the (e.g., flowrate-dependent) power law model described above. For example, the flowrate-independent power law model may describe the flowrate-independent behavior of the downhole motor according to the following formula:

$$\frac{RPM_m(Q)}{Q} = rpg \times \left(1 - \left(\frac{\alpha \Delta P_a}{Q}\right)^k\right)$$

Where:

Q is the flowrate;

$RPM_m(Q)$ is the motor rotational speed at the flowrate Q;

rpg is the volumetric motor rotational output under a no load condition;

$\propto$ is a constant representing the inverse of the stall pressure for any flowrate Q;

$\Delta P_a$ is the total active differential pressure across the motor; and

K is the slip factor of the motor.

The flowrate-independent RPM power curve 544 of FIG. 5 may be based on this flowrate-independent power law model (e.g., equation) for the RPM output of the motor at any flowrate. The power law model engine 124 may generate the flowrate-independent RPM power curve 544 based on fitting the flowrate-independent power law model to a set of RPM data 546. The RPM data 546 may be RPM data that is observed or measured during one or more operations of the downhole motor at any flowrate. For example, the RPM data 546 may be associated with a single flowrate, or may be associated with many flowrates. In some embodiments, the RPM data 546 may be flowrate-independent RPM data that is generated by the data manager to generalize the measured values of the RPM data to any flowrate, as described herein. For example, as shown in FIG. 5, the RPM data 546 may relate and RPM of the downhole motor divided by the associated flowrate to a differential pressure of the downhole motor also divided by the associated flowrate.

In this way, the flowrate-independent RPM power curve 544 may be based on data that was taken at any (or any number of) flowrates, and additionally may characterize and/or predict the performance of the downhole motor for any flowrate. For example, because the flowrate-independent RPM power curve 544 is based on data independent of flowrate, the flowrate-independent RPM power curve may accurately represent the motor performance for operations of the downhole motor at the same or different flowrates from the flowrates upon which the RPM data 546 is based. In this way, the flowrate-independent RPM power curve 544 may facilitate informing the operation of the downhole motor for an operation of the downhole motor at any flowrate, including those for which no (or an insufficient quantity) of RPM data is available and for which a specific flowrate-dependent RPM power curve is not available.

Additionally, the RPM data 546 may be data taken during an operation of the downhole motor and may be taken in real time. In some embodiments, the power law model engine 124 may generate and/or update the flowrate-independent RPM power curve 544 in real time based on the real time RPM data 546. Thus, the flowrate-independent RPM power curve 544 may provide an accurate understanding of the motor performance that may update and/or change with changing conditions of the operation of the downhole motor.

The power law model engine 124 may fit the flowrate-independent RPM power curve 544 (and may fit any of the curves, models, or equations described herein) to the RPM data 546 based on any suitable technique. For example, the power law model engine 124 may implement any statistical or mathematical technique for optimizing the model parameters of the flowrate-independent power law model in order to minimize the difference between the predicted flowrate-independent RPM power curve 544 and the RPM data 546. For instance, the power law model engine 124 may implement a least squares regression, maximum likelihood estimation, or any other technique.

As mentioned above, the model parameter $\alpha(Q)$ may represent the inverse of the stall pressure, and may be dependent (e.g., may change based on) the flowrate. As described herein, the flowrate-independent power law model may implement $\alpha$ as a constant that approximates the inverse stall pressure for any flowrate. In some embodiments, the power law model engine 124 may calculate and/or approximate $\alpha$ for the flowrate-independent power law model. For example, the power law model engine 124 may approximate $\alpha$ based on one or more $\alpha(Q)$ values for data (of specific flowrate(s)) in the RPM data 546. The power law model engine 124 may approximate $\alpha$ as a statistical average, mean, median, mode, quartile, or any other calculation of $\alpha(Q)$ values in order that $\alpha$ may represent (or sufficiently represent) the inverse stall pressure for any flowrate for which the flowrate-independent RPM power curve 544 may apply. In this way, the $\alpha$ value implemented in the flowrate-independent power law model may approximate the flowrate-specific $\alpha(Q)$ values of the data instances of the RPM data 546.

Figure 6:
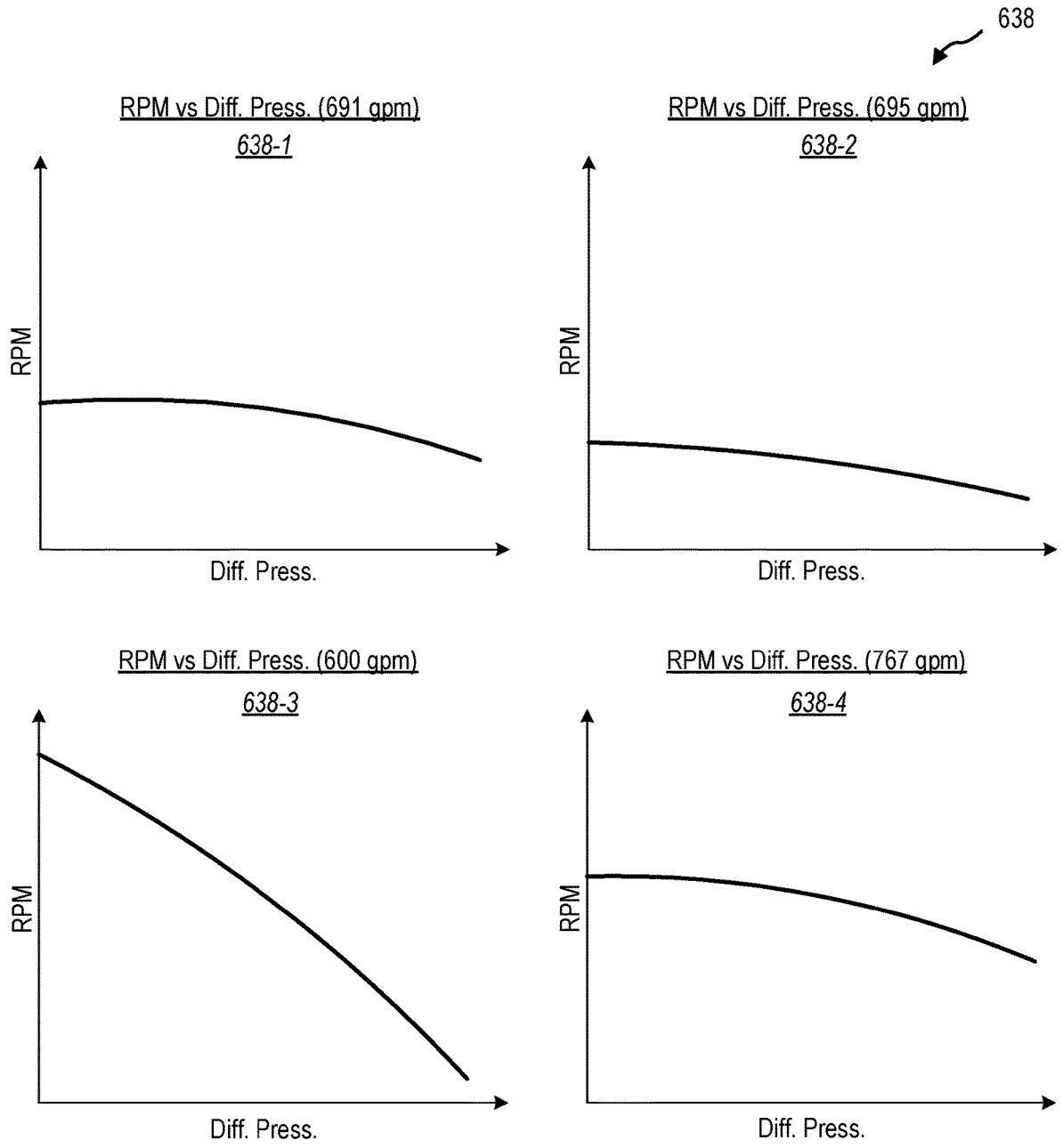
FIG. 6 illustrates several example flowrate-dependent RPM power curves, according to at least one embodiment of the present disclosure.

In some embodiments, it may be advantageous to generate one or more flow-rate dependent RPM power curves for one or more specific flowrates of interest. FIG. 6 illustrates several example flowrate-dependent RPM power curves 638-1, 638-2, 638-3, and 638-4 (collectively RPM power curves 638), according to at least one embodiment of the present disclosure.

In some embodiments, the power law model engine 124 generates the RPM power curves 638 based on the flowrate-independent RPM power curve and/or based on the flowrate-independent power law model. For example, in fitting the flowrate-independent power law model to the RPM data (associated with one or many different flowrates) the power law model engine 124 may calculate, approximate, or otherwise solve for various model parameters and/or coefficients. As an example, the power law model engine 124 may determine values for $RPM_0$, rpg, k, $\alpha$, or any other model parameter. Some (or all) of these model parameters may be the same model parameters as in (e.g., equally applicable to)

the flowrate-dependent RPM power law model described above. In some embodiments, the power law model engine 124 may apply the determined model parameters (from fitting the flowrate-independent RPM power curve) to the flowrate-dependent power law model in order to generate one or more flowrate-dependent RPM power curves for one or more specific flowrates of interest. For example, as shown in FIG. 6, based on applying the determined $RPM_0$, rpg, k, and $\alpha$ values (e.g., determined from the flowrate-independent power law model) to the flowrate-dependent power law model, the power law model engine may generate a first RPM power curve 638-1 for a flowrate of 691 gallons per minute (gpm), a second RPM power curve 638-2 for a flowrate of 695 gpm, a third RPM power curve 638-3 for a flowrate of 600 gpm, and a fourth RPM power curve 638-4 for a flowrate of 767 gpm.

Generating flow-rate dependent power curves in this way may be beneficial for understanding and/or predicting the behavior of the downhole motor at these specific flowrates of interest. For example, it may be desirable to understand how a downhole motor will perform at a specific flowrate. In some cases, insufficient RPM data may be available for that specific flowrate in order to generate an RPM power curve for that flowrate. By generating the flowrate-independent RPM power curve and applying the associated model parameters to the flowrate-dependent power law model, an accurate and useful RPM power curve may be generated for a specific flowrate for which RPM data is not available. In this way, the power law model engine 124 may generate any number of flowrate-dependent RPM power curves for any number of flowrates whether data for those specific flowrates is known or not.

The techniques described herein may be beneficial for informing how to operate a downhole motor. For example, based on the flowrate-independent RPM power curve and/or based on a flowrate-dependent power curve (for RPM and/or torque) one or more operational parameters may be changed or adjusted in order to achieve a desired result. For instance, it may be desirable to operate the downhole motor at an increased RPM or at an increased level of torque. Based on one or more power curves generated by the power curve generation system 120, the operator may adjust one or more operational parameters in order to precisely control the resulting behavior of the downhole motor. As an example, the SWOB may be adjusted to cause a corresponding change in differential pressure in order to achieve a desired motor RPM and/or motor torque. As another example, the downhole motor may be made to operate at a different flow rate in order to achieve a particular output. Additionally, the power curves described herein may be generated and updated in real time to accurately reflect the present behavior and better predict how the downhole motor will respond to the present downhole conditions (e.g., environmental conditions, formation properties, tool wear, etc.).

As mentioned above, the power curve generation system 120 includes a validation manager 126. The validation manager 126 may validate the flowrate-independent power curve generated by the power law model engine 124 to ensure that it is accurate and correctly predicts the expected motor performance. The validation manager 126 may also validate any of the flowrate-dependent power curves using similar techniques.

As described above, in fitting the flowrate-independent power law model to the RPM data, the power law model engine 124 determines various model parameters or coefficients. In particular, the power law model engine 124 may determine or predict an rpg value for the downhole motor. In many cases, the tool specification for the downhole motor may indicate a measured, calculated, or otherwise determined rpg value provided by the manufacturer. In some embodiments, the validation manager 126 may compare the predicted rpg value determined by the power law model engine 124 to the rpg value provided in the tool spec. Based on these two rpg values being the same, similar, or within a threshold range, the validation manager may conclude that the flowrate-independent RPM power curve is accurate. For example, the validation manager may verify that the predicted rpg value is within 0.005, 0.01, 0.015, 0.02 or any other threshold range of the tool spec rpg.

Figures 1, 7:
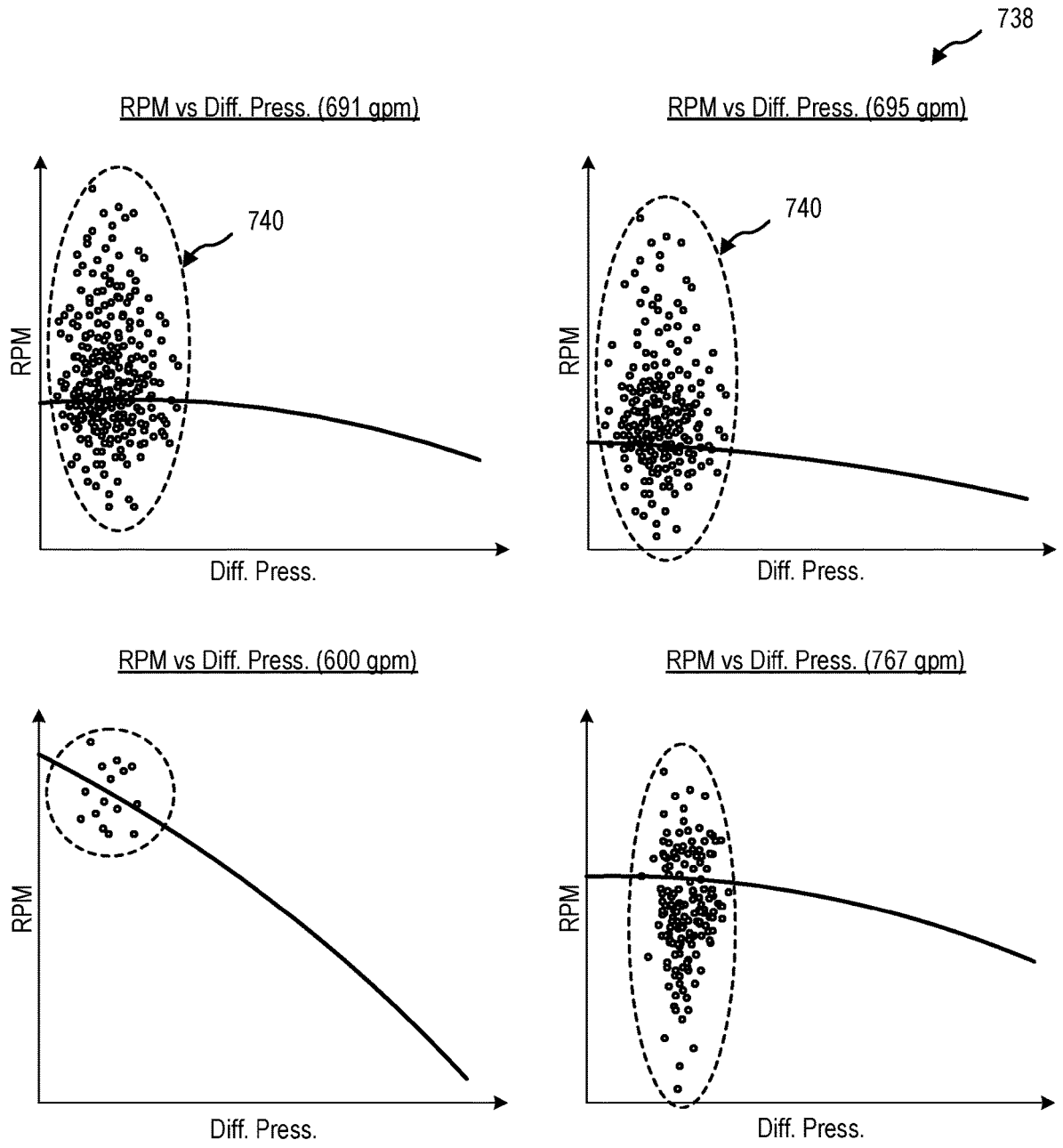
Figures 2, 7:
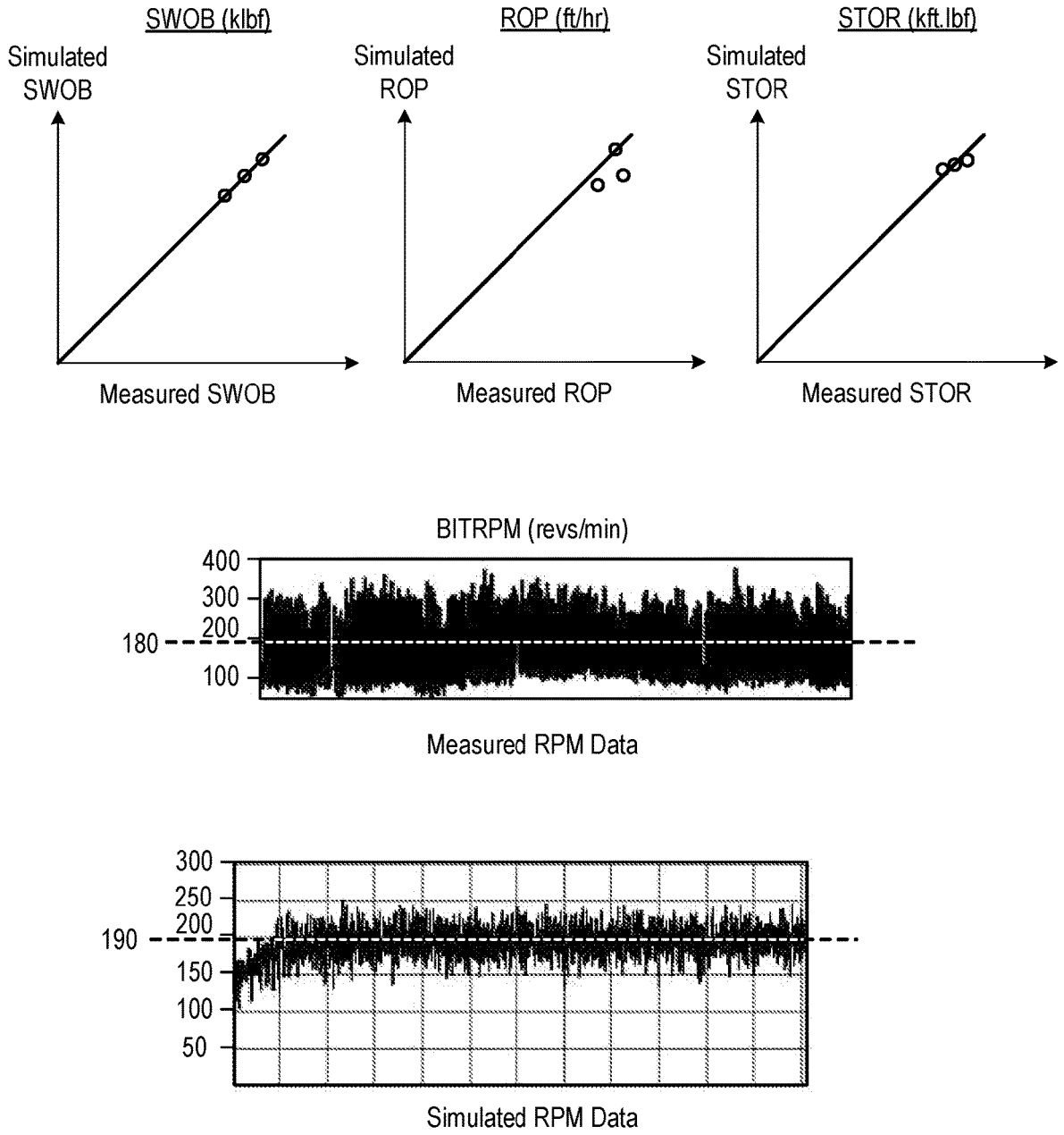

As described above, in some cases the power law model engine 124 may generate one or more flowrate-dependent RPM power curves, such as that describe in connection with FIG. 6. FIG. 7-1 illustrates several example flowrate-dependent RPM power curves 738 in accordance with at least one embodiment of the present disclosure. In some embodiments, the flowrate-dependent RPM power curves 738 may be the same as the flowrate-dependent RPM power curve 638 of FIG. 6.

In some embodiments, the validation manager 126 may validate the flowrate-independent RPM power curve based on comparing one or more of the flowrate-dependent RPM power curves 738 to RPM data 740 collected for the associated flowrates. For example, the power law model engine 124 may generate one or more flowrate-dependent RPM power curves for one or more flowrates for which RPM data 740 has been collected or is otherwise known. As shown in FIG. 7-1, the validation manager 126 may compare these flowrate-dependent RPM power curves 738 to the associated RPM data 740 for the associated flowrates. Based on this comparison, the validation manager 126 may determine whether and/or to what extent the flowrate-dependent RPM power curves 738 accurately represent the measured RPM data for the associated flowrate. For example, the validation manager 126 may determine a level of error or inaccuracy with the fit of the flowrate-dependent RPM power curves 738 to the associated RPM data 740. Because the flowrate-dependent RPM power curves 738 are generated based on (e.g., by applying the model parameters from) the flowrate-independent RPM power curve, the validation manager 126 may infer the accuracy of the flowrate-independent RPM power curve based on the determined accuracy of the flowrate-dependent RPM power curves 738.

In some embodiments, the power curve generation system 120 (e.g., more specifically, the power law model engine 124 or the validation manager 126) may calculate or predict one or more operational parameters of the downhole system. For example, based on the predicted motor response defined by the flowrate-independent RPM power curve, the power curve generation system 120 may simulate an operation of the downhole motor. The power curve generation system 120 may apply the flowrate-independent RPM power curve to the simulation and may determine one or more operational parameters of the downhole system, such as a SWOB, ROP, STOR, RPM, or any other relevant parameter.

In some embodiments, the validation manager 126 may implement one or more of the simulated operational parameters for validating the flowrate-independent RPM power curve. For example, the validation manager 126 may compare one or more of the simulated operational parameters to one or more measured operational parameters taken during an operation of the downhole motor under the same or similar conditions to that of the simulation. Based on an accuracy for the simulated values to represent the equivalent measured parameters, the validation manager 126 may determine whether and to what extend the flowrate-independent RPM power curve correctly predicted the behavior of the downhole motor.

FIG. 7-2 illustrates several example operational parameters for an operation of the downhole motor, according to at least one embodiment of the present disclosure. As shown in FIG. 7-2, the power curve generation system 120 may simulate or predict a SWOB, ROP, STOR and RPM. The power curve generation system 120 may predict one or more values for each of these parameters. The validation manager 126 may compare these values to one or more measured values for the associated parameter to verify the accuracy of the flowrate-independent RPM power curve. For example, as shown in FIG. 7-2, the simulated values for SWOB, ROP and STOR are shown to closely approximate the associated measured values. Similarly, the simulated RPM, which shows and average of about 190 revolutions per minute closely approximates the measured RPM values, which has an average of about 180 revolutions per minute. In this way, the validation manager may ensure the accuracy of the flowrate-independent RPM power curve generated by the power law model engine 124. The validation manager 126 may validate through any other suitable technique.

In some embodiments, the validation manager 126 may verify that the flowrate-independent RPM power curve is accurate and/or applicable to a particular flowrate of interest. For example, as described above, the flowrate-independent RPM power curve may be generated based on approximating and/or calculating a model parameter $\alpha$ which may substantially approximate $\alpha(Q)$ values for many different flowrates. This may be an acceptable approximation due to the fact that the $\alpha(Q)$ values may be substantially similar (e.g., may vary an acceptable and/or negligible amount) for different flowrates that are similar, or within a threshold range. For example, $\alpha$ may be an acceptable $\alpha(Q)$ approximation for flowrates that are all within 50 gpm, within 100 gpm, within 150 gpm, or some other threshold of each other (e.g., or from an average $\alpha(Q)$ value). However, in some cases, for flowrates that vary more than an associated threshold, the constant $\alpha$ may not be an acceptable approximation for the associated $\alpha(Q)$ value. Accordingly, the flowrate-independent RPM power curve may not sufficiently represent the motor response for these substantially different flowrates.

In some embodiments, the validation manager 126 may identify when the flowrate-independent RPM power curve does not sufficiently apply to a given flowrate of an associated operation of the downhole motor. For example, the validation manager 126 may verify that the flowrate is not within an associated threshold range. In another example, the validation manager 126 may determine, through one or more of the validation methods described above, that the flowrate-independent RPM power curve does not accurately represent the performance of the downhole motor, and may accordingly conclude that the reason is that the associated flowrate is not within an associated threshold of the underlying RPM data. Accordingly, the validation manager may determine through one or more techniques that the $\alpha$ value does not adequately apply to the particular flowrate of interest.

In some embodiments, the validation manager 126 may indicate (e.g., to the power law model engine 124) that a new, additional, or updated flowrate-independent RPM power curve needs to be generated in order to accurately predict the motor behavior. For example, the power law model engine 124 may determine an updated a value in order to generate a flowrate-independent RPM power curve with a better fit. In some embodiments, the power law model engine 124 may generate two or more flowrate-independent RPM power curves, for example, to represent ranges of similar flowrates. In this way, the validation manager may further ensure the accuracy of the flowrate-independent RPM power curve.

While the techniques of the present disclosure have been primarily described with respect to a particular power law model, it should be understood that any suitable model, equation, or relationship may be implemented in similar ways in order to implement the techniques described herein. Indeed, while the downhole motor behavior has been shown to be described by a particular power law model including a particular set of equations, other models and equations for characterizing motor behavior are conceivable and contemplated by this disclosure.

Figure 8:
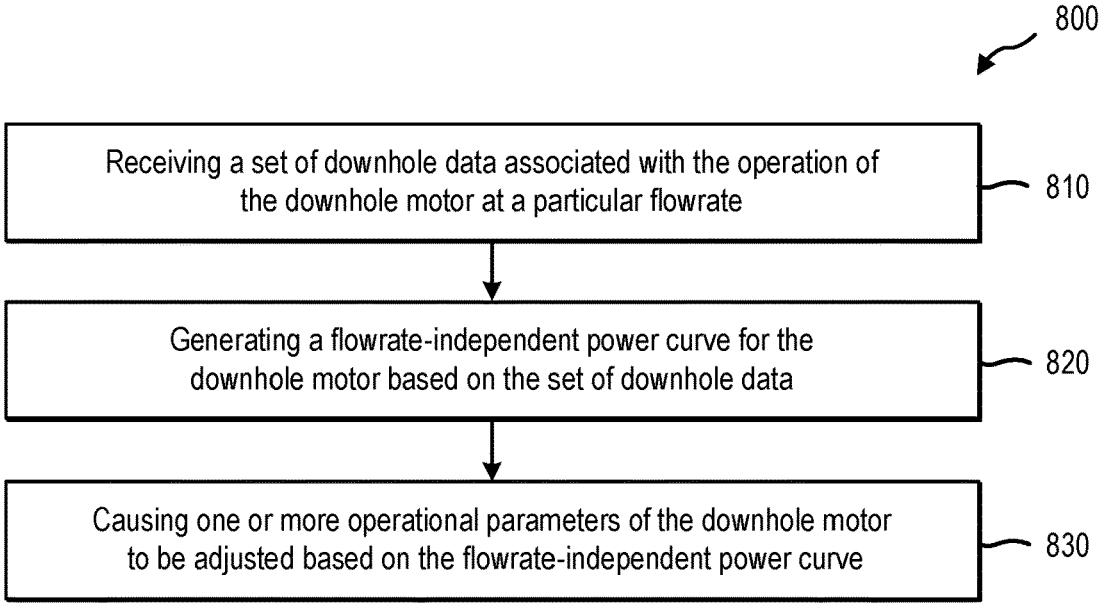
FIG. 8 illustrates a method or a series of acts for evaluating an operation of a downhole motor implemented in a wellbore as described herein, according to at least one embodiment of the present disclosure.

FIG. 8 illustrates a method 800 or a series of acts for evaluating an operation of a downhole motor implemented in a wellbore as described herein, according to at least one embodiment of the present disclosure. While FIG. 8 illustrates acts according to one embodiment, alternative embodiments may add to, omit, reorder, or modify any of the acts of FIG. 8. In some embodiments, the acts may be performed as a method. In some embodiments, the acts may be performed by a system. In some embodiments, the acts may be instructions stored on a computer-readable storage medium.

In some embodiments, the method 800 includes an act 810 of receiving a set of downhole data associated with the operation of the downhole motor at a particular flowrate. For example, the set of downhole data may include one or more data instances that indicate a motor rotational speed (RPM) with respect to a differential pressure of the downhole motor at the particular flowrate. The differential pressure of the downhole motor may be based on a surface weight on bit.

In some embodiments, the method 800 includes an act 820 of generating a flowrate-independent power curve for the downhole motor based on the set of downhole data. For example, the flowrate-independent power curve may be generated based on fitting a flowrate-independent power law model to the set of downhole data. The flowrate-independent power curve may indicate a flowrate-independent RPM of the downhole motor with respect to a flowrate-independent differential pressure of the downhole motor. In some embodiments, receiving the set of downhole data and generating the flowrate-independent power curve are performed in real time during the operation of the downhole motor. In some embodiments, an additional set of downhole data may be received that is associated with an operation of the downhole motor at an additional flowrate. Generating the flowrate-independent power curve may be based on the set of downhole data of the particular flowrate and based on the additional set of downhole data of the additional flowrate.

In some embodiments, the method includes, based on the flowrate-independent power curve, determining a second set of downhole data associated with the operation of the downhole motor at a second flowrate. The second set of downhole data may include one or more second data instances that indicate motor RPM with respect to differential pressure of the downhole motor at the second flowrate. In some embodiments, the flowrate-independent power curve may be validated based on comparing the second set of downhole data to measured data taken during the operation of the downhole motor at the second flowrate.

In some embodiments, the flowrate-independent power curve may be validated based on determining a predicted rotation per gallon (rpg) for the downhole motor based on the flowrate-independent model, and comparing the predicted rpg to a tool specification for the downhole motor. In some embodiments, one or more operational parameter values for the downhole motor may be predicted based on the flowrate-independent power curve. For example, the predicted operational parameter values may include one or more of a predicted SWOB, a predicted ROP, a predicted STOR, or a predicted RPM associated with the operation of the downhole motor. In some embodiments, the flowrate-independent power curve may be validated based on comparing the one or more predicted operational parameter values to one or more measured operational parameter values for the downhole motor.

In some embodiments, the method 800 includes an act 830 of, causing one or more operational parameters of the downhole motor to be adjusted based on the flowrate-independent power curve.

Figure 9:
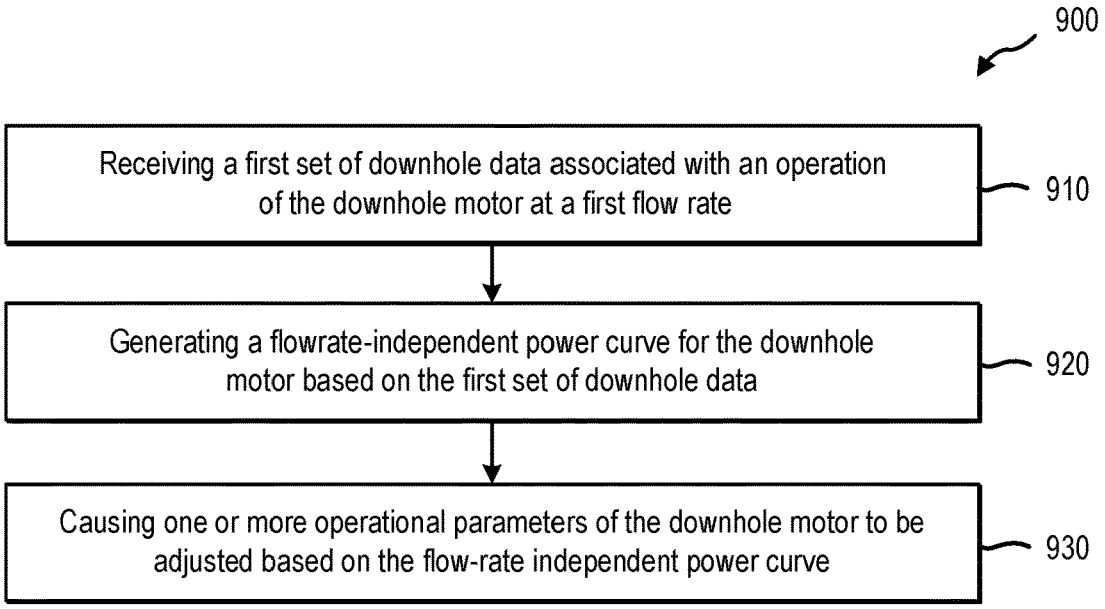
FIG. 9 illustrates a method or a series of acts for operating a downhole motor implemented in a wellbore as described herein, according to at least one embodiment of the present disclosure.

FIG. 9 illustrates a method 900 or a series of acts for operating a downhole motor implemented in a wellbore as described herein, according to at least one embodiment of the present disclosure. While FIG. 9 illustrates acts according to one embodiment, alternative embodiments may add to, omit, reorder, or modify any of the acts of FIG. 9.

In some embodiments, the method 900 includes an act 910 of receiving a first set of downhole data associated with an operation of the downhole motor at a first flowrate.

In some embodiments, the method 900 includes an act 920 of generating a flow-rate independent power curve for the downhole motor based on the first set of downhole data. The flowrate-independent power curve may relate an RPM of the downhole motor to a differential pressure of the downhole motor irrespective of an associated flowrate of the downhole motor.

In some embodiments, the method 900 includes an act 930 of causing one or more operational parameters of the downhole motor to be adjusted based on the flow-rate independent power curve. For example, the downhole motor may be caused to operate at a second flowrate that is different from the first flowrate based on the flowrate-independent power curve. In another example, the differential pressure of the downhole motor may be adjusted based on causing a SWOB of the downhole motor to be adjusted. In another example, an RPM of the downhole motor may be adjusted based on causing the differential pressure of the downhole motor to be adjusted.

In some embodiments, receiving the first set of downhole data, generating the flowrate-independent power curve, and causing the one or more operational parameters of the downhole motor to be adjusted may be performed in real time during the operation of the downhole motor.

Figure 10:
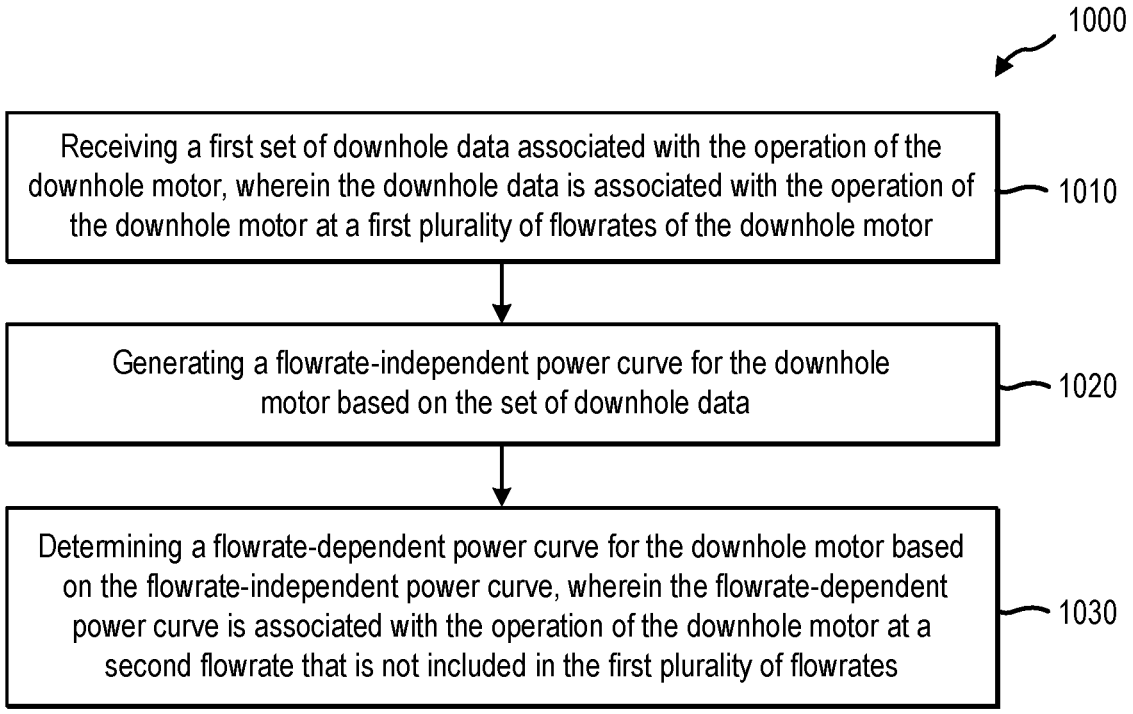
FIG. 10 illustrates a method or a series of acts for evaluating an operation of a downhole motor implemented in a wellbore as described herein, according to at least one embodiment of the present disclosure.

FIG. 10 illustrates a method 1000 or a series of acts for evaluating an operation of a downhole motor implemented in a wellbore as described herein, according to at least one embodiment of the present disclosure. While FIG. 10 illustrates acts according to one embodiment, alternative embodiments may add to, omit, reorder, or modify any of the acts of FIG. 10.

In some embodiments, the method 1000 may include an act 1010 of receiving a set of downhole data associated with the operation of the downhole motor, wherein the downhole data is associated with the operation of the downhole motor at a first plurality of different flowrates of the downhole motor.

In some embodiments, the method 1000 may include an act 1020 of generating a flowrate-independent power curve for the downhole motor based on the set of downhole data.

In some embodiments the method 1000 may include an act 1030 of determining a flowrate-dependent power curve for the downhole motor based on the flowrate-independent power curve, wherein the flowrate-dependent power curve is associated with an operation of the downhole motor at a second flowrate that is not included in the first plurality of flowrates. For example, generating the flowrate-independent power curve may include determining a set of model parameters for fitting a flowrate-independent power law model to the set of downhole data. Determining the flowrate-dependent power curve may be based on applying the set of model parameters and the second flowrate to a flowrate-dependent power law model.

Figure 11:
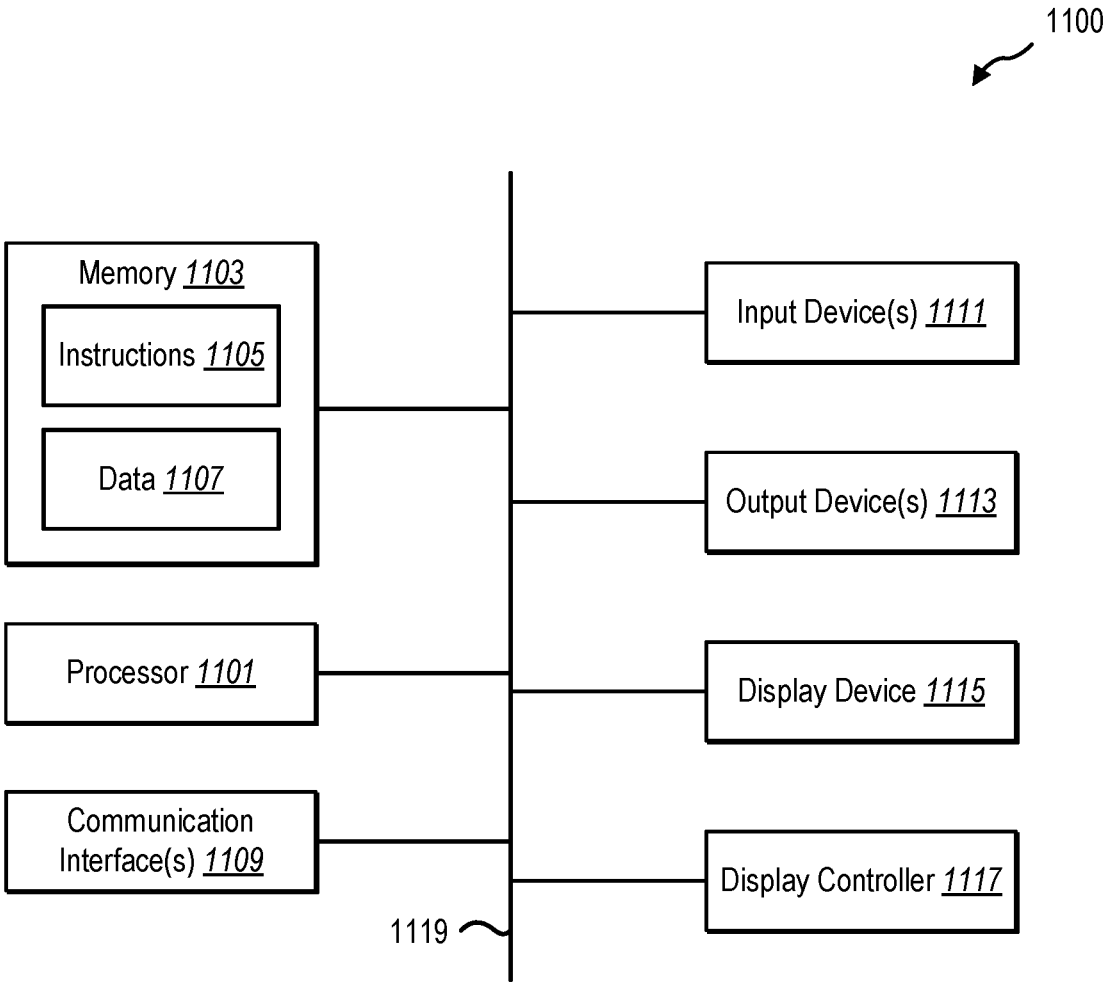
FIG. 11 illustrates certain components that may be included within a computer system.

Turning now to FIG. 11, this figure illustrates certain components that may be included within a computer system 1100. One or more computer systems 1100 may be used to implement the various devices, components, and systems described herein.

The computer system 1100 includes a processor 1101. The processor 1101 may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 1101 may be referred to as a central processing unit (CPU). Although just a single processor 1101 is shown in the computer system 1100 of FIG. 11, in an alternative configuration, a combination of processors (e.g., an ARM and DSP) could be used.

The computer system 1100 also includes memory 1103 in electronic communication with the processor 1101. The memory 1103 may include computer-readable storage media and can be any available media that can be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure can comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored or in software, hardware, firmware, or combinations thereof.

Instructions 1105 and data 1107 may be stored in the memory 1103. The instructions 1105 may be executable by the processor 1101 to implement some or all of the functionality disclosed herein. Executing the instructions 1105 may involve the use of the data 1107 that is stored in the memory 1103. Any of the various examples of modules and components described herein may be implemented, partially or wholly, as instructions 1105 stored in memory 1103 and executed by the processor 1101. Any of the various examples of data described herein may be among the data 1107 that is stored in memory 1103 and used during execution of the instructions 1105 by the processor 1101.

A computer system 1100 may also include one or more communication interfaces 1109 for communicating with other electronic devices. The communication interface(s) 1109 may be based on wired communication technology, wireless communication technology, or both. Some examples of communication interfaces 1109 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces 1109 may connect the computer system 1100 to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instruction or data structures and which can be accessed by a general purpose or special purpose computer.

A computer system 1100 may also include one or more input devices 1111 and one or more output devices 1113. Some examples of input devices 1111 include a keyboard, mouse, microphone, remote control device, button, joystick, trackball, touchpad, and lightpen. Some examples of output devices 1113 include a speaker and a printer. One specific type of output device that is typically included in a computer system 1100 is a display device 1115. Display devices 1115 used with embodiments disclosed herein may utilize any suitable image projection technology, such as liquid crystal display (LCD), light-emitting diode (LED), gas plasma, electroluminescence, or the like. A display controller 1117 may also be provided, for converting data 1107 stored in the memory 1103 into one or more of text, graphics, or moving images (as appropriate) shown on the display device 1115.

The various components of the computer system 1100 may be coupled together by one or more buses, which may include one or more of a power bus, a control signal bus, a status signal bus, a data bus, other similar components, or combinations thereof. For the sake of clarity, the various buses are illustrated in FIG. 11 as a bus system 1119.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures can be transferred automatically or manually from transmission media to non-transitory computer-readable storage media (or vice versa). For example, computer executable instructions or data structures received over a network or data link can be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media can be included in computer system components that also (or even primarily) utilize transmission media.

INDUSTRIAL APPLICABILITY

In some embodiments, a downhole system is described for drilling an earth formation to form a wellbore. The downhole system includes a drill rig used to turn a drilling tool assembly which extends downward into the wellbore. The drilling tool assembly may include a drill string, a bottomhole assembly ("BHA"), and a bit, attached to the downhole end of the drill string.

The drill string may include several joints of drill pipe connected end-to-end through tool joints. The drill string transmits drilling fluid through a central bore and transmits rotational power from the drill rig to the BHA. In some embodiments, the drill string further includes additional downhole drilling tools and/or components such as subs, pup joints, etc. The drill pipe provides a hydraulic passage through which drilling fluid is pumped from the surface. The drilling fluid discharges through selected-size nozzles, jets, or other orifices in the bit for the purposes of cooling the bit and cutting structures thereon, and for lifting cuttings out of the wellbore as it is being drilled.

The BHA may include the bit, other downhole drilling tools, or other components. An example BHA may include additional or other downhole drilling tools or components (e.g., coupled between the drill string and the bit). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system may include other downhole drilling tools, components, and accessories such as special valves (e.g., kelly cocks, blowout preventers, and safety valves). Additional components included in the downhole system may be considered a part of the drilling tool assembly the drill string or a part of the BHA 106, depending on their locations in the downhole system.

The bit in the BHA may be any type of bit suitable for degrading downhole materials. For instance, the bit may be a drill bit suitable for drilling the earth formation. Example types of drill bits used for drilling earth formations are fixed-cutter or drag bits. In other embodiments, the bit may be a mill used for removing metal, composite, elastomer, other materials downhole, or combinations thereof. For instance, the bit may be used with a whipstock to mill into casing lining the wellbore The bit may also be a junk mill used to mill away tools, plugs, cement, other materials within the wellbore or combinations thereof. Swarf or other cuttings formed by use of a mill may be lifted to the surface or may be allowed to fall downhole. The bit may include one or more cutting elements for degrading the earth formation.

The BHA may further include a rotary steerable system (RSS). The RSS may include directional drilling tools that change a direction of the bit, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit, change the course of the bit, and direct the directional drilling tools on a projected trajectory. The RSS may steer the bit in accordance with or based on a trajectory for the bit. For example, a trajectory may be determined for directing the bit toward one or more subterranean targets such as an oil or gas reservoir.

The downhole system may include or may be associated with one or more client devices with a power curve generation system implemented thereon (e.g., implemented on one, several, or across multiple client devices). The power curve generation system may facilitate calculating and/or assessing forces and/or other parameters that may act on the drill string in association with the drill string advancing into or being retrieved from the wellbore.

In some embodiments, a power curve generation system is implemented in example environment in accordance with one or more embodiments described herein. In some embodiments, the example environment includes one or more server device(s). The server device(s) may include one or more computing devices (e.g., including processing units, data storage, etc.) organized in an architecture with various network interfaces for connecting to and providing data management and distribution across one or more client systems. The server devices may be connected to and may communicate with (either directly or indirectly) one or more client devices through a network. The network may include one or multiple networks and may use one or more communication platforms and/or technologies suitable for transmitting data. The network may refer to any data link that enables transport of electronic data between devices of the environment. The network may refer to a hardwired network, a wireless network, or a combination of a hardwired network and a wireless network. In one or more embodiments, the network includes the internet. The network may be configured to facilitate communication between the various computing devices via well-site information transfer standard markup language (WITSML) or similar protocol, or any other protocol or form of communication.

The client device may refer to various types of computing devices. For example, one or more client devices may include a mobile device such as a mobile telephone, a smartphone, a personal digital assistant (PDA), a tablet, a laptop, or any other portable device. Additionally, or alternatively, the client devices may include one or more non-mobile devices such as a desktop computer, server device, surface or downhole processor or computer (e.g., associated with a sensor, system, or function of the downhole system), or other non-portable device. In one or more implementations, the client devices include graphical user interfaces (GUI) thereon (e.g., a screen of a mobile device). In addition, or as an alternative, one or more of the client devices may be communicatively coupled (e.g., wired or wirelessly) to a display device having a graphical user interface thereon for providing a display of system content. The server device (s) may similarly refer to various types of computing devices. Each of the devices of the environment may include features and/or functionalities described below.

The environment may include a power curve generation system implemented on one or more computing devices. The power curve generation system may be implemented on one or more client device, server devices, and combinations thereof. Additionally, or alternatively, the power curve generation system may be implemented across the client devices and/or the server devices such that different portions or components of the power curve generation system are implemented on different computing devices in the environment. In this way, the environment may be a cloud computing environment, and the power curve generation system may be implemented across one or more devices of the cloud computing environment in order to leverage the processing capabilities, memory capabilities, connectivity, speed, etc., that such cloud computing environments offer in order to facilitate the features and functionalities described herein.

In some embodiments, an example implementation of the power curve generation system is described herein, according to at least one embodiment of the present disclosure.

The power curve generation system may include a data manager, a power law model engine, and a validation manager. The power curve generation system may also include a data storage having downhole system data and power curve data stored thereon. While one or more embodiments described herein describe features and functionalities performed by specific components of the power curve generation system, it will be appreciated that specific features described in connection with one component of the power curve generation system may, in some examples, be performed by one or more of the other components of the power curve generation system.

By way of example, one or more of the data receiving, gathering, or storing features of the data manager may be delegated to other components of the power curve generation system. As another example, while a validation of the power curves may be performed by a validation manager, in some instances, some or all of these features may be performed by the power law model engine (or other component of the power curve generation system). Indeed, it will be appreciated that some or all of the specific components may be combined into other components and specific functions may be performed by one or across multiple components of the power curve generation system.

Additionally, the power curve generation system has been described as implemented on a client device of the downhole system, it should be understood that some or all of the features and functionalities of the power curve generation system may be implemented on or across multiple client devices and/or server devices. For example, data may be input and/or received by the data manager on a (e.g., local) client device, and the downhole model may be generated and/or simulated on one or more of a remote, server, or cloud device. Indeed, it will be appreciated that some or all of the specific components may be implemented on or across multiple client devices and/or server devices, including individual functions of a specific component being performed across multiple devices.

As mentioned above, the power curve generation system includes a data manager. The data manager may receive a variety of types of data associated with the downhole system and may store the data to the data storage. The data manager may receive the data from a variety of sources, such as from sensors, surveying tools, downhole tools, other (e.g., client) devices, libraries, databases, user input, etc.

In some embodiments, the data manager receives downhole system data. The downhole system data may include any data associated with the downhole system, such as measurements from one or more sensors, parameters of an operation of the downhole system, information about the downhole system, etc. The data manager may store any of this information to the data storage as downhole system data. The data manager may receive the downhole system data in real time (e.g., periodically and/or continuously) in order to facilitate the real-time power curve generation techniques described herein.

In some embodiments, the downhole system data includes information associated with a downhole motor or mud motor implemented in the wellbore. The downhole system data may include RPM data, or data associated with a rotational speed of the downhole motor and/or the downhole system generally. For example, the RPM data may include surface RPM data related to a rotational speed of the downhole system at the surface of the wellbore. For example, the downhole system may rotate the drill string (including the downhole motor) from or at the surface and the surface RPM may indicate this rotational speed. The surface RPM data may be measured by one or more surface sensors. In another example, the RPM data may include downhole or motor RPM data related to a rotational speed with which the downhole motor is driven to rotate within the wellbore. The downhole RPM data may incorporate and/or take into account a surface RPM or may be independent of an applied surface RPM. For example, a drilling fluid may be pumped through the downhole motor in order to drive a rotation of the motor within the wellbore. This may be in addition to the rotation of the entire drill string (including the downhole motor) from the surface, or the surface RPM. In some instances, the downhole RPM may indicate the rotation of the downhole motor with respect to the rotation (or lack thereof) of the drill string. In this way the downhole or motor RPM may indicate the isolated rotational speed of the motor. In some embodiments, the motor RPM is measured with one or more downhole sensors. In some embodiments, as described herein, the downhole or motor RPM may be predicted, calculated, or inferred based on a generated RPM power curve.

In some embodiments, the downhole system data includes torque data associated with a torque output or exhibited by the downhole motor. For example, the downhole motor may rotate one or more downhole tools, such as a drill bit, and the downhole motor may accordingly impart a torque to the downhole tool in order to degrade the formation. The torque may be resultant from the drilling fluid pumped through the power section of the motor. The torque data may be measured or observed by one or more downhole sensors. In some embodiments, as described herein, the torque data may be predicted, calculated, or inferred based on a generated torque power curve.

In some embodiments, the downhole system data includes drilling fluid data associated with the drilling fluid flowing to and/or through the downhole motor. For example, a volume, flowrate, pressure, etc., of the drilling fluid flowing through the motor may define the behavior or performance of the downhole motor, including the RPM and/or torque output. For instance, the torque and/or RPM output of the downhole motor may be characterized with respect to a differential pressure of the downhole motor. Similarly, the behavior (e.g., torque and/or RPM vs differential pressure) may be influenced or affected by the flowrate of the drilling fluid through the downhole motor. Thus, the drilling fluid data may indicate various metrics for the drilling fluid such as the differential pressure and flowrate in order to characterize the performance of the downhole motor and to facilitate the techniques described herein. The drilling fluid data may be received through measurements of one or more downhole sensors or measurement devices.

In some embodiments, the downhole system data includes operational parameter data associated with parameters, settings, values, etc., of an operation of the downhole system. For example, the operational parameter data may indicate a weight on bit (WOB) and/or rate of penetration (ROP) of the downhole system. The WOB and/or ROP may be a value applied and/or measured at the surface, and/or may include one or more measurements taken within the wellbore.

In some embodiments, the data manager receives specification and/or technical data associated with the downhole motor. For example, the data manager may receive or access a tool specification for the downhole motor, for example, provided by a manufacturer of the downhole motor. The tool specification may include information about the design, features, and performance characteristics of the downhole motor. For example, as described herein, the tool specification may include RPM and/or torque power curves for the downhole motor. The tool specification may indicate one or more parameters or constants for the downhole motor and/or for a power curve of the downhole motor, such as a rotations per gallon (rpg) parameter for the downhole motor as described herein.

In some embodiments, the data manager receives wellbore data associated with the wellbore, the formation, and or the downhole environment. The wellbore data may indicate a depth, location, orientation, trajectory, etc., of one or more portions (or all) of the wellbore. For example, the wellbore data may indicate at what measurement depth an operation of interest of the downhole motor took place. The wellbore data may indicate one or more properties of a formation, such as the type, composition, and properties of a formation associated with an operation of the downhole motor. The wellbore data may indicate one or more properties of the downhole environment, such as a downhole static pressure and/or temperature.

In some embodiments, the data manager receives user input. The data manager may receive the user input, for example, via any of the client devices and/or server devices. Any of the data described herein may be input or augmented via the user input. For example, in some instances, some or all of the downhole system data is received by the data manager as user input. The user input may be received in association with one or more functions or features of the power curve generation system, such as part of validating the generated power curve(s), or any other feature described herein.

In some embodiments, the data manager cleans some or all of the data of the data storage. For example, the data manager may receive data in a variety of forms. The data manager may profile the data to understand its structure, format, quality, etc. Based on the profiling, the data manager may check for issues such as missing values, duplicate entries, outliers, inconsistent formats, etc. The data manager may validate the data against one or more predefined rules and/or standards such as verifying that data is in an expected format or falls within an expected range. In some embodiments, the data manager addresses any errors or inconsistencies. For example, the data manager may remove incorrect, inconsistent, or duplicate entries. In another example, the data manager may correct incorrect, inconsistent, or missing entries, such as by estimating or averaging values based on an associated context. In another example, the data manager may standardize the format or transform the format of the data for consistency. In another example, the data manager may flag data issues for manual review and/or may facilitate a user correcting data issues. In this way, the data manager may facilitate identifying and/or correcting errors, inconsistencies, or inaccuracies in the data to make the data more reliable and useful.

As mentioned above, in some embodiments, some of the data may be associated with specific flow rates of the drilling fluid through the downhole motor. For example, the data manager may receive torque data, RPM data, and differential pressure data associated with an operation of the downhole motor at one or more specific flow rates. As described herein, the power curve generation system may generate a flowrate-independent RPM power curve for the downhole motor based on the downhole system data. In some embodiments, the data manager may aggregate or combine some or all of the downhole system data from its specific flow rate to an aggregation of downhole data that is independent or irrespective of flowrate. For example, the data storage may take the data received for an operation of the downhole motor at various different flowrates and may combine the data into an aggregated data set of data from all of the various different flowrates. This flowrate-independent aggregation of data may facilitate generating the flowrate-independent RPM power curve as described herein. In some embodiments, the data manager may modify some or all of the RPM data to generate flowrate-independent RPM data. For example, the data manager may divide a value or measurement of the RPM data by the flowrate at which it was taken. For instance, the RPM data may include a measurement of rotational speed at a corresponding differential pressure. The data manager may divide the rotational speed and/or differential pressure values by the corresponding flowrate to generate flowrate-independent values for these measurements. In this way, the data manager may generate flowrate-independent RPM data that is generalized to all (or any possible) flowrate of the downhole motor.

In some embodiments, the behavior, performance, or output of a downhole motor may be characterized and/or defined by one or more power curves. For example, a power curve may characterize an output torque with respect to a differential fluid pressure across the power section (e.g., rotor and stator) of the downhole motor. In another example, a power curve may characterize an RPM of the downhole motor with respect to the differential fluid pressure. In many cases, it is important to understand what differential pressures will achieve desired RPM and torque outputs of the motor. For example, a given application or operation may have an optimal or desirable RPM and/or torque range for operating the downhole motor efficiently and effectively. For instance, too much torque could damage the downhole motor and/or an associated downhole tool. Too much or too little torque could be ineffective or inefficient. Further, downhole motors may experience fatigue and/or wear if operated in certain windows for extended periods of time. Thus, a power curve may facilitate a downhole operation by informing how, and with what operational parameters to operate the downhole motor in order to achieve a desired outcome. For example, adjusting the WOB may influence the differential pressure exhibited across the downhole motor, which may in turn affect the torque and/or RPM output by the downhole motor. This motor response may change and/or may be dependent on a particular flow rate of the fluid through the downhole motor. These operational parameters may be determined based on understanding how the motor will respond in a given application, which can be learned from a power curve.

In many cases a downhole motor may be provided with a tool specification that may include one or more power curves for the motor. While these power curves may be useful, in many cases they may not be precise, accurate, and/or may not reflect the real-world and/or changing conditions that the downhole motor is subject to. For example, tool spec power curves may be generic to all of the downhole motors of a specific type or variety of a given manufacturer. Thus, variations (e.g., from manufacture, assembly, use, etc.) from one downhole motor to the next may not be reflected in a generic tool spec power curve. Additionally, as described above, motor performance may be affected by any of a variety of factors associated with a specific implementation or use of the downhole motor. A generic tool spec power curve may be applicable to a general application or use of the downhole motor and may accordingly not be attuned to the specific operational conditions and operational parameters of a given operation of the downhole motor. Thus, while a tool spec power curve may be beneficial in some regards and/or may get close to characterizing motor behavior, in some cases these generic power curves may not reflect the motor performance with sufficient accuracy.

As mentioned above, the power curve generation system includes a power law model engine. The power law model engine may facilitate generating one or more power curves specific to the downhole motor, and to a specific application of the downhole motor. For example, the power curve generation system may generate one or more power curves, such as a torque power curve and/or an RPM power curve based on the downhole system data taken during an operation of the motor.

In some embodiments, the motor performance may be characterized by a power law model. The power law model may relate outputs of the downhole motor, such as torque and RPM, to various model parameters represented by coefficients or constants. For example, the power law model may describe the torque output of the downhole motor according to the following formula:

$$T = \beta \Delta P_a - \gamma \Delta P_a^2$$

Where:

T is the downhole torque;

$\Delta P_a$ is the total active differential pressure across the motor power section;

$\beta$ is a positive coefficient; and $\gamma$ is a positive coefficient, where $\beta >> \gamma$.

The torque power curve may be based on this power law model (e.g., equation) for the torque output of the motor. The torque power curve may be substantially linear or may include a substantially linear region. For example, the downhole motor may have a working range of differential pressure defined as $\Delta P_{limit}$. When the motor is within the working range of the differential pressure, or when $\Delta P_a < \Delta P_{limit}$, then $\gamma = 0$, as reflected in the linear region of the torque power curve. $\beta$ is represented as the torque flow, or a positive coefficient that relates the changes in differential pressure to the torque output of the downhole motor. In some embodiments, the torque power curve may have a curved region or a region of decay that is not substantially linear. For example, if the differential pressure exceeds the working range, or if $\Delta P_a \geq \Delta P_{limit}$, then the motor may begin to operate less efficiently, and increases in the differential pressure may not equate to proportionate increased in torque output. $\gamma$ is represented as a positive coefficient to reflect the inefficiencies in the motor to convert the energy of the fluid pressure into torque at these elevated differential pressures.

In some embodiments, the power law model engine may generate the torque power curve based on fitting the power law model (e.g., torque equation) for the torque to a set of torque data. As described above, the torque data may be data taken during an operation of the downhole motor and may be taken in real time. In some embodiments, the power law model engine may generate and/or update the torque power curve in real time based on the real time torque data. In this way, the torque power curve fitted to the torque data may characterize how the downhole motor is responding and/or behaving during an actual operation of the downhole motor and with respect to the actual downhole conditions of the specific application. This may be beneficial for informing how to operate and/or adjust the downhole motor in order to achieve a desired torque output, as the torque power curve may incorporate and/or account for a variety of factors that may affect (and/or are presently affecting) the performance of the downhole motor as described herein. In this way, the torque power curve may predict with an increased accuracy the response of the downhole motor, for example, over that of a generic or tool spec power curve.

As described herein, in some embodiments, the torque data is data associated with a specific flowrate of the drilling fluid through the downhole motor. Thus, a torque power curve generated by the power law model engine in this way may be applicable to, or may be associated with, the specific flowrate at which the associated torque data was taken. As described herein, in some embodiments the power law model engine may generate a flowrate-independent RPM power curve for informing the operation of the downhole motor independent of the flowrate. Unlike the RPM, however, in some embodiments, the torque power curve may not vary significantly with different flowrates. For example, a torque power curve may be substantially similar for different torque data taken at different flowrates to the that of the torque data. In this way, a torque power curve may be generated which may be applicable and useful for facilitating the operation of the downhole motor at any number of flowrates.

In some embodiments, the power law model may characterize the rotational speed output (RPM) of the downhole motor. For example, the power law model may describe the motor RPM according on the following formula:

$$RPM_m(Q) = RPM_0(Q)\left(1 - (\propto(Q)\Delta P_a)^k\right)$$

Where:

Q is the flowrate;

$RPM_m(Q)$ is the motor rotational speed at the flowrate Q;

$RPM_0(Q)=rpg\times Q$ is the reference motor rotational speed at Q;

rpg is the volumetric motor rotational output under a no load condition;

$\propto(Q)$ is the inverse of the stall pressure at the flowrate Q;

$\Delta P_a$ is the total active differential pressure across the motor; and

K is the slip factor of the motor.

The RPM power curve may be based on the power law model (e.g., RPM equation) for the RPM output of the motor. The power law model engine may generate the RPM power curve based on fitting the power law model for the RPM to a set of RPM data. As described above, the RPM data may be data taken during an operation of the downhole motor and may be taken in real time. In some embodiments, the power law model engine may generate and/or update the RPM power curve in real time based on the real time RPM data. In this way, the RPM power curve fitted to the RPM data may characterize how the downhole motor is responding and/or behaving during an actual operation of the downhole motor and with respect to the actual downhole conditions of the specific application. This may be beneficial for informing how to operate and/or adjust the downhole motor in order to achieve a desired RPM output, as the RPM power curve may incorporate and/or account for a variety of factors that may (and/or are presently affecting) the performance of the downhole motor as described herein. In this way, the RPM power curve may predict with an increased accuracy the response of the downhole motor, for example, over that of a generic or tool spec power curve.

As described herein, the RPM data may be associated with a specific flowrate of the drilling fluid through the downhole motor. Thus, the RPM power curve may be applicable to, or may be associated with, the specific flowrate at which associated RPM data was taken. Thus, the RPM power curve may be a flowrate-dependent RPM power curve (and the power law model described above may be a flowrate-dependent power law model). Accordingly, the benefits of the RPM power curve may be limited in their applicability to operations of the downhole motor at the same (or possibly similar) flow rates of the downhole motor. For example, the downhole motor may perform differently under different flow rates, and the RPM power curve may not accurately represent the motor response under these different flow rates. Thus, the benefits of informing how to efficiently and effectively operate a downhole motor according to an RPM power curve in this way may be limited by the number of RPM power curves that can be generated for specific operating flowrates of the downhole motor. In other words, for flowrates with which an RPM power curve is not available or cannot be generated, the behavior of the downhole motor may not be accurately predicted (e.g., for flowrates with which an insufficient quantity of RPM data is available).

In some embodiments, the power law model engine generates a flowrate-independent RPM power curve for describing the downhole motor response independent of the particular flowrate with which the motor may operate.

In some embodiments, a flowrate-independent power law model may be implemented to characterize the flow-rate independent behavior of the downhole motor. For example, the flowrate-independent power law model may describe the RPM output of the motor with respect to the differential pressure in a way that generalized to all (or any possible) flowrate. The flowrate-independent power law model may be derived from the (e.g., flowrate-dependent) power law model described above. For example, the flowrate-independent power law model may describe the flowrate-independent behavior of the downhole motor according to the following formula:

$$\frac{RPM_m(Q)}{Q} = rpg\times\left(1 - \left(\frac{\alpha\Delta P_a}{Q}\right)^k\right)$$

Where:

Q is the flowrate;

$RPM_m(Q)$ is the motor rotational speed at the flowrate Q;

rpg is the volumetric motor rotational output under a no load condition;

$\propto$ is a constant representing the inverse of the stall pressure for any flowrate Q;

$\Delta P_a$ is the total active differential pressure across the motor; and

K is the slip factor of the motor.

The flowrate-independent RPM power curve may be based on this flowrate-independent power law model (e.g., equation) for the RPM output of the motor at any flowrate. The power law model engine may generate the flowrate-independent RPM power curve based on fitting the flowrate-independent power law model to a set of RPM data. The RPM data may be RPM data that is observed or measured during one or more operations of the downhole motor at any flowrate. For example, the RPM data may be associated with a single flowrate or may be associated with many flowrates. In some embodiments, the RPM data may be flowrate-independent RPM data that is generated by the data manager to generalize the measured values of the RPM data to any flowrate, as described herein. For example, the RPM data may relate and RPM of the downhole motor divided by the associated flowrate to a differential pressure of the downhole motor also divided by the associated flowrate.

In this way, the flowrate-independent RPM power curve may be based on data that was taken at any (or any number of) flowrates, and additionally may characterize and/or predict the performance of the downhole motor for any flowrate. For example, because the flowrate-independent RPM power curve is based on data independent of flowrate, the flowrate-independent RPM power curve may accurately represent the motor performance for operations of the downhole motor at the same or different flowrates from the flowrates upon which the RPM data is based. In this way, the flowrate-independent RPM power curve may facilitate informing the operation of the downhole motor for an operation of the downhole motor at any flowrate, including those for which no (or an insufficient quantity) of RPM data is available and for which a specific flowrate-dependent RPM power curve is not available.

Additionally, the RPM data may be data taken during an operation of the downhole motor and may be taken in real time. In some embodiments, the power law model engine may generate and/or update the flowrate-independent RPM power curve in real time based on the real time RPM data. Thus, the flowrate-independent RPM power curve may provide an accurate understanding of the motor performance that may update and/or change with changing conditions of the operation of the downhole motor.

The power law model engine may fit the flowrate-independent RPM power curve (and may fit any of the curves, models, or equations described herein) to the RPM data based on any suitable technique. For example, the power law model engine may implement any statistical or mathematical technique for optimizing the model parameters of the flowrate-independent power law model in order to minimize the difference between the predicted flowrate-independent RPM power curve and the RPM data. For instance, the power law model engine may implement a least squares regression, maximum likelihood estimation, or any other technique.

As mentioned above, the model parameter $\alpha(Q)$ may represent the inverse of the stall pressure, and may be dependent (e.g., may change based on) the flowrate. As described herein, the flowrate-independent power law model may implement $\alpha$ as a constant that approximates the inverse stall pressure for any flowrate. In some embodiments, the power law model engine may calculate and/or approximate $\alpha$ for the flowrate-independent power law model. For example, the power law model engine may approximate $\alpha$ based on one or more $\alpha(Q)$ values for data (of specific flowrate(s)) in the RPM data. The power law model engine may approximate $\alpha$ as a statistical average, mean, median, mode, quartile, or any other calculation of $\alpha(Q)$ values in order that $\alpha$ may represent (or sufficiently represent) the inverse stall pressure for any flowrate for which the flowrate-independent RPM power curve may apply. In this way, the $\alpha$ value implemented in the flowrate-independent power law model may approximate the flowrate-specific $\alpha(Q)$ values of the data instances of the RPM data.

In some embodiments, it may be advantageous to generate one or more flow-rate dependent RPM power curves for one or more specific flowrates of interest.

In some embodiments, the power law model engine generates the RPM power curves based on the flowrate-independent RPM power curve and/or based on the flowrate-independent power law model. For example, in fitting the flowrate-independent power law model to the RPM data (associated with one or many different flowrates) the power law model engine may calculate, approximate, or otherwise solve for various model parameters and/or coefficients. As an example, the power law model engine may determine values for $RPM_0$, rpg, k, $\alpha$, or any other model parameter. Some (or all) of these model parameters may be the same model parameters as in (e.g., equally applicable to) the flowrate-dependent RPM power law model described above. In some embodiments, the power law model engine may apply the determined model parameters (from fitting the flowrate-independent RPM power curve) to the flowrate-dependent power law model in order to generate one or more flowrate-dependent RPM power curves for one or more specific flowrates of interest. For example, based on applying the determined $RPM_0$, rpg, k, and $\alpha$ values (e.g., determined from the flowrate-independent power law model) to the flowrate-dependent power law model, the power law model engine may generate a first RPM power curve for a flowrate of gallons per minute (gpm), a second RPM power curve for a flowrate of gpm, a third RPM power curve for a flowrate of gpm, and a fourth RPM power curve for a flowrate of gpm.

Generating flow-rate dependent power curves in this way may be beneficial for understanding and/or predicting the behavior of the downhole motor at these specific flowrates of interest. For example, it may be desirable to understand how a downhole motor will perform at a specific flowrate. In some cases, insufficient RPM data may be available for that specific flowrate in order to generate an RPM power curve for that flowrate. By generating the flowrate-independent RPM power curve and applying the associated model parameters to the flowrate-dependent power law model, an accurate and useful RPM power curve may be generated for a specific flowrate for which RPM data is not available. In this way, the power law model engine may generate any number of flowrate-dependent RPM power curves for any number of flowrates whether data for those specific flowrates is known or not.

The techniques described herein may be beneficial for informing how to operate a downhole motor. For example, based on the flowrate-independent RPM power curve and/or based on a flowrate-dependent power curve (for RPM and/or torque) one or more operational parameters may be changed or adjusted in order to achieve a desired result. For instance, it may be desirable to operate the downhole motor at an increased RPM or at an increased level of torque. Based on one or more power curves generated by the power curve generation system, the operator may adjust one or more operational parameters in order to precisely control the resulting behavior of the downhole motor. As an example, the SWOB may be adjusted to cause a corresponding change in differential pressure in order to achieve a desired motor RPM and/or motor torque. As another example, the downhole motor may be made to operate at a different flow rate in order to achieve a particular output. Additionally, the power curves described herein may be generated and updated in real time to accurately reflect the present behavior and better predict how the downhole motor will respond to the present downhole conditions (e.g., environmental conditions, formation properties, tool wear, etc.).

As mentioned above, the power curve generation system includes a validation manager. The validation manager may validate the flowrate-independent power curve generated by the power law model engine to ensure that it is accurate and correctly predicts the expected motor performance. The validation manager may also validate any of the flowrate-dependent power curves using similar techniques.

As described above, in fitting the flowrate-independent power law model to the RPM data, the power law model engine determines various model parameters or coefficients. In particular, the power law model engine may determine or predict an rpg value for the downhole motor. In many cases, the tool specification for the downhole motor may indicate a measured, calculated, or otherwise determined rpg value provided by the manufacturer. In some embodiments, the validation manager may compare the predicted rpg value determined by the power law model engine to the rpg value provided in the tool spec. Based on these two rpg values being the same, similar, or within a threshold range, the validation manager may conclude that the flowrate-independent RPM power curve is accurate. For example, the validation manager may verify that the predicted rpg value is within 0.005, 0.01, 0.015, 0.02 or any other threshold range of the tool spec rpg.

As described above, in some cases the power law model engine may generate one or more flowrate-dependent RPM power curves, such as that describe above. In some embodiments, the flowrate-dependent RPM power curves may be the same as the flowrate-dependent RPM power curve.

In some embodiments, the validation manager may validate the flowrate-independent RPM power curve based on comparing one or more of the flowrate-dependent RPM power curves to RPM data collected for the associated flowrates. For example, the power law model engine may generate one or more flowrate-dependent RPM power curves for one or more flowrates for which RPM data has been collected or is otherwise known. The validation manager may compare these flowrate-dependent RPM power curves to the associated RPM data for the associated flowrates. Based on this comparison, the validation manager may determine whether and/or to what extent the flowrate-dependent RPM power curves accurately represent the measured RPM data for the associated flowrate. For example, the validation manager may determine a level of error or inaccuracy with the fit of the flowrate-dependent RPM power curves to the associated RPM data. Because the flowrate-dependent RPM power curves are generated based on (e.g., by applying the model parameters from) the flowrate-independent RPM power curve, the validation manager may infer the accuracy of the flowrate-independent RPM power curve based on the determined accuracy of the flowrate-dependent RPM power curves.

In some embodiments, the power curve generation system (e.g., more specifically, the power law model engine or the validation manager) may calculate or predict one or more operational parameters of the downhole system. For example, based on the predicted motor response defined by the flowrate-independent RPM power curve, the power curve generation system may simulate an operation of the downhole motor. The power curve generation system may apply the flowrate-independent RPM power curve to the simulation and may determine one or more operational parameters of the downhole system, such as a SWOB, ROP, STOR, RPM, or any other relevant parameter.

In some embodiments, the validation manager may implement one or more of the simulated operational parameters for validating the flowrate-independent RPM power curve. For example, the validation manager may compare one or more of the simulated operational parameters to one or more measured operational parameters taken during an operation of the downhole motor under the same or similar conditions to that of the simulation. Based on an accuracy for the simulated values to represent the equivalent measured parameters, the validation manager may determine whether and to what extend the flowrate-independent RPM power curve correctly predicted the behavior of the downhole motor.

In some embodiments, the power curve generation system may simulate or predict a SWOB, ROP, STOR and RPM. The power curve generation system may predict one or more values for each of these parameters. The validation manager may compare these values to one or more measured values for the associated parameter to verify the accuracy of the flowrate-independent RPM power curve. For example, the simulated values for SWOB, ROP and STOR may closely approximate the associated measured values. Similarly, the simulated RPM, may have an average revolutions per minute that closely approximates the measured RPM values. In this way, the validation manager may ensure the accuracy of the flowrate-independent RPM power curve generated by the power law model engine. The validation manager may validate through any other suitable technique.

In some embodiments, the validation manager may verify that the flowrate-independent RPM power curve is accurate and/or applicable to a particular flowrate of interest. For example, as described above, the flowrate-independent RPM power curve may be generated based on approximating and/or calculating a model parameter $\alpha$ which may substantially approximate $\alpha(Q)$ values for many different flowrates. This may be an acceptable approximation due to the fact that the $\alpha(Q)$ values may be substantially similar (e.g., may vary an acceptable and/or negligible amount) for different flowrates that are similar, or within a threshold range. For example, $\alpha$ may be an acceptable $\alpha(Q)$ approximation for flowrates that are all within 50 gpm, within 100 gpm, within 150 gpm, or some other threshold of each other (e.g., or from an average $\alpha(Q)$ value). However, in some cases, for flowrates that vary more than an associated threshold, the constant $\alpha$ may not be an acceptable approximation for the associated $\alpha(Q)$ value. Accordingly, the flowrate-independent RPM power curve may not sufficiently represent the motor response for these substantially different flowrates.

In some embodiments, the validation manager may identify when the flowrate-independent RPM power curve does not sufficiently apply to a given flowrate of an associated operation of the downhole motor. For example, the validation manager may verify that the flowrate is not within an associated threshold range. In another example, the validation manager may determine, through one or more of the validation methods described above, that the flowrate-independent RPM power curve does not accurately represent the performance of the downhole motor, and may accordingly conclude that the reason is that the associated flowrate is not within an associated threshold of the underlying RPM data. Accordingly, the validation manager may determine through one or more techniques that the $\alpha$ value does not adequately apply to the particular flowrate of interest.

In some embodiments, the validation manager may indicate (e.g., to the power law model engine) that a new, additional, or updated flowrate-independent RPM power curve needs to be generated in order to accurately predict the motor behavior. For example, the power law model engine may determine an updated a value in order to generate a flowrate-independent RPM power curve with a better fit. In some embodiments, the power law model engine may generate two or more flowrate-independent RPM power curves, for example, to represent ranges of similar flowrates. In this way, the validation manager may further ensure the accuracy of the flowrate-independent RPM power curve.

While the techniques of the present disclosure have been primarily described with respect to a particular power law model, it should be understood that any suitable model, equation, or relationship may be implemented in similar ways in order to implement the techniques described herein. Indeed, while the downhole motor behavior has been shown to be described by a particular power law model including a particular set of equations, other models and equations for characterizing motor behavior are conceivable and contemplated by this disclosure.

In some embodiments, a method or a series of acts for evaluating an operation of a downhole motor implemented in a wellbore is described herein. In some embodiments, the acts may be performed as a method. In some embodiments, the acts may be performed by a system. In some embodiments, the acts may be instructions stored on a computer-readable storage medium.

In some embodiments, the method includes an act of receiving a set of downhole data associated with the operation of the downhole motor at a particular flowrate. For example, the set of downhole data may include one or more data instances that indicate a motor rotational speed (RPM) with respect to a differential pressure of the downhole motor at the particular flowrate. The differential pressure of the downhole motor may be based on a surface weight on bit.

In some embodiments, the method includes an act of generating a flowrate-independent power curve for the downhole motor based on the set of downhole data. For example, the flowrate-independent power curve may be generated based on fitting a flowrate-independent power law model to the set of downhole data. The flowrate-independent power curve may indicate a flowrate-independent RPM of the downhole motor with respect to a flowrate-independent differential pressure of the downhole motor. In some embodiments, receiving the set of downhole data and generating the flowrate-independent power curve are performed in real time during the operation of the downhole motor. In some embodiments, an additional set of downhole data may be received that is associated with an operation of the downhole motor at an additional flowrate. Generating the flowrate-independent power curve may be based on the set of downhole data of the particular flowrate and based on the additional set of downhole data of the additional flowrate.

In some embodiments, the method includes, based on the flowrate-independent power curve, determining a second set of downhole data associated with the operation of the downhole motor at a second flowrate. The second set of downhole data may include one or more second data instances that indicate motor RPM with respect to differential pressure of the downhole motor at the second flowrate. In some embodiments, the flowrate-independent power curve may be validated based on comparing the second set of downhole data to measured data taken during the operation of the downhole motor at the second flowrate.

In some embodiments, the flowrate-independent power curve may be validated based on determining a predicted rotation per gallon (rpg) for the downhole motor based on the flowrate-independent model, and comparing the predicted rpg to a tool specification for the downhole motor. In some embodiments, one or more operational parameter values for the downhole motor may be predicted based on the flowrate-independent power curve. For example, the predicted operational parameter values may include one or more of a predicted SWOB, a predicted ROP, a predicted STOR, or a predicted RPM associated with the operation of the downhole motor. In some embodiments, the flowrate-independent power curve may be validated based on comparing the one or more predicted operational parameter values to one or more measured operational parameter values for the downhole motor.

In some embodiments, the method 800 includes an act of, causing one or more operational parameters of the downhole motor to be adjusted based on the flowrate-independent power curve.

In some embodiments, a method or a series of acts is described herein for operating a downhole motor implemented in a wellbore as described herein, according to at least one embodiment of the present disclosure.

In some embodiments, the method includes an act of receiving a first set of downhole data associated with an operation of the downhole motor at a first flowrate.

In some embodiments, the method includes an act of generating a flow-rate independent power curve for the downhole motor based on the first set of downhole data. The flowrate-independent power curve may relate an RPM of the downhole motor to a differential pressure of the downhole motor irrespective of an associated flowrate of the downhole motor.

In some embodiments, the method includes an act of causing one or more operational parameters of the downhole motor to be adjusted based on the flow-rate independent power curve. For example, the downhole motor may be caused to operate at a second flowrate that is different from the first flowrate based on the flowrate-independent power curve. In another example, the differential pressure of the downhole motor may be adjusted based on causing a SWOB of the downhole motor to be adjusted. In another example, an RPM of the downhole motor may be adjusted based on causing the differential pressure of the downhole motor to be adjusted.

In some embodiments, receiving the first set of downhole data, generating the flowrate-independent power curve, and causing the one or more operational parameters of the downhole motor to be adjusted may be performed in real time during the operation of the downhole motor.

In some embodiments, a method or a series of acts is described herein for evaluating an operation of a downhole motor implemented in a wellbore as described herein, according to at least one embodiment of the present disclosure.

In some embodiments, the method may include an act of receiving a set of downhole data associated with the operation of the downhole motor, wherein the downhole data is associated with the operation of the downhole motor at a first plurality of different flowrates of the downhole motor.

In some embodiments, the method may include an act of generating a flowrate-independent power curve for the downhole motor based on the set of downhole data.

In some embodiments the method may include an act of determining a flowrate-dependent power curve for the downhole motor based on the flowrate-independent power curve, wherein the flowrate-dependent power curve is associated with an operation of the downhole motor at a second flowrate that is not included in the first plurality of flowrates. For example, generating the flowrate-independent power curve may include determining a set of model parameters for fitting a flowrate-independent power law model to the set of downhole data. Determining the flowrate-dependent power curve may be based on applying the set of model parameters and the second flowrate to a flowrate-dependent power law model.

In some embodiments, certain components may be included within a computer system. One or more computer systems may be used to implement the various devices, components, and systems described herein.

The computer system includes a processor. The processor may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU). Although just a single processor is described, in an alternative configuration, a combination of processors (e.g., an ARM and DSP) could be used.

The computer system also includes memory in electronic communication with the processor. The memory may include computer-readable storage media and can be any available media that can be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure can comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored or in software, hardware, firmware, or combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces may connect the computer system to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instruction or data structures and which can be accessed by a general purpose or special purpose computer.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into one or more of text, graphics, or moving images (as appropriate) shown on the display device.

The various components of the computer system may be coupled together by one or more buses, which may include one or more of a power bus, a control signal bus, a status signal bus, a data bus, other similar components, or combinations thereof.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures can be transferred automatically or manually from transmission media to non-transitory computer-readable storage media (or vice versa). For example, computer executable instructions or data structures received over a network or data link can be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media can be included in computer system components that also (or even primarily) utilize transmission media.

The following description includes various embodiments that, where feasible, may be combined in any permutation. For example, the embodiment described below may be combined with any or all embodiments of the following paragraphs. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a method of evaluating an operation of a downhole motor implemented in a wellbore includes receiving a set of downhole data associated with the operation of the downhole motor at a particular flowrate. The method further includes generating a flowrate-independent power curve for the downhole motor based on the set of downhole data. The method further includes causing one or more operational parameters of the downhole motor to be adjusted based on the flowrate-independent power curve.

In some embodiments, the flowrate-independent power curve indicates a flowrate-independent RPM of the downhole motor with respect to a flowrate-independent differential pressure of the downhole motor.

In some embodiments, receiving the set of downhole data includes receiving one or more data instances that indicate a motor rotational speed (RPM) with respect to a differential pressure of the downhole motor at the particular flowrate.

In some embodiments, the differential pressure of the downhole motor is based on a surface weight on bit (SWOB).

In some embodiments, the method further includes, based on the flowrate-independent power curve, determining a second set of downhole data associated with the operation of the downhole motor at a second flowrate.

In some embodiments, the second set of downhole data includes one or more second data instances that indicate motor RPM with respect to differential pressure of the downhole motor at the second flowrate.

In some embodiments, the method further includes validating the flowrate-independent power curve based on comparing the second set of downhole data to measured data taken during the operation of the downhole motor at the second flowrate.

In some embodiments, receiving the set of downhole data and generating the flowrate-independent power curve are performed in real time during the operation of the downhole motor.

In some embodiments, generating the flowrate-independent power curve includes fitting a flowrate-independent power law model to the set of downhole data.

In some embodiments, the method further includes receiving an additional set of downhole data associated with the operation of the downhole motor at an additional flowrate and generating the flowrate-independent power curve is based on the set of downhole data of the particular flowrate and the additional set of downhole data of the additional flowrate.

In some embodiments, the method further includes validating the flowrate-independent power curve based on determining a predicted rotation per gallon (rpg) for the downhole motor based on the flowrate-independent power curve, and comparing the predicted rpg to a tool specification for the downhole motor.

In some embodiments, the method further includes predicting one or more operational parameters for the downhole motor based on the flowrate-independent power curve.

In some embodiments, the one or more predicted operational parameters includes one or more of a predicted SWOB, a predicted rate of penetration (ROP), a predicted a surface torque (STOR), or a predicted RPM associated with the operation of the downhole motor.

In some embodiments, the method further includes validating the flowrate-independent power curve based on comparing the one or more predicted operational parameters to one or more measured operational parameters for the downhole motor.

In some embodiments, a system includes at least one processor, memory in electronic communication with the at least one processor, and instructions stored in the memory, the instructions being executable by the at least one processor to receive a set of downhole data associated with an operation of a downhole motor at a particular flowrate, generate a flowrate-independent power curve for the downhole motor based on the set of downhole data, and cause one or more operational parameters of the downhole motor to be adjusted based on the flowrate-independent power curve.

In some embodiments, the flowrate-independent power curve indicates a flowrate-independent RPM of the downhole motor with respect to a flowrate-independent differential pressure of the downhole motor.

In some embodiments, causing the one or more operational parameters of the downhole motor to be adjusted includes causing the downhole motor to operate at a second flowrate that is different from the particular flowrate based on the flowrate-independent power curve.

In some embodiments, a computer-readable storage medium includes instruction that, when executed by at least one processor, cause the processor to receive a set of downhole data associated with an operation of a downhole motor at a particular flowrate generate a flowrate-independent power curve for the downhole motor based on the set of downhole data, and cause one or more operational parameters of the downhole motor to be adjusted based on the flowrate-independent power curve.

In some embodiments, the flowrate-independent power curve indicates a flowrate-independent RPM of the downhole motor with respect to a flowrate-independent differential pressure of the downhole motor.

In some embodiments, the instructions are further executable to, based on the flowrate-independent power curve, determine a second set of downhole data associated with the operation of the downhole motor at a second flowrate, wherein causing the one or more operational parameters to be adjusted is based on the second set of downhole data.

The embodiments of the power curve generation system have been primarily described with reference to wellbore drilling operations; the power curve generation system described herein may be used in applications other than the drilling of a wellbore. In other embodiments, the power curve generation system according to the present disclosure may be used outside a wellbore or other downhole environment used for the exploration or production of natural resources. For instance, the power curve generation system of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of evaluating an operation of a downhole motor implemented in a wellbore, comprising:

receiving a set of downhole data associated with the operation of the downhole motor at a first flowrate;

generating a flowrate-independent power curve for the downhole motor using the set of downhole data by fitting a flowrate-independent power law model to the set of downhole data and solving the flowrate-independent power law model for model parameters of the flowrate-independent power law model at the first flowrate;

generating, using the flowrate-independent power curve, new operational parameters for the downhole motor to transition to a new flowrate by solving the flowrate-independent power law model for the new operational parameters at the new flowrate; and adjusting the downhole motor to the new generated operational parameters to operate at the new flowrate.

2. The method of claim 1, wherein the flowrate-independent power curve indicates a flowrate-independent RPM of the downhole motor with respect to a flowrate-independent differential pressure of the downhole motor.

3. The method of claim 1, wherein receiving the set of downhole data includes receiving one or more data instances that indicate a motor rotational speed (RPM) with respect to a differential pressure of the downhole motor at the first flowrate.

4. The method of claim 3, wherein the differential pressure of the downhole motor is based on a surface weight on bit (SWOB).

5. The method of claim 1, further comprising, based on the flowrate-independent power curve, determining a second set of downhole data associated with the operation of the downhole motor at a second flowrate.

6. The method of claim 5, wherein the second set of downhole data includes one or more second data instances that indicate motor RPM with respect to differential pressure of the downhole motor at the second flowrate.

7. The method of claim 5, further including validating the flowrate-independent power curve based on comparing the second set of downhole data to measured data taken during the operation of the downhole motor at the second flowrate.

8. The method of claim 1, wherein receiving the set of downhole data and generating the flowrate-independent power curve are performed in real time during the operation of the downhole motor.

9. The method of claim 1, further comprising receiving an additional set of downhole data associated with the operation of the downhole motor at an additional flowrate, wherein generating the flowrate-independent power curve is based on the set of downhole data of the first flowrate and the additional set of downhole data of the additional flowrate.

10. The method of claim 1, further including validating the flowrate-independent power curve based on:

determining a predicted rotation per gallon (rpg) for the downhole motor based on the flowrate-independent power curve; and comparing the predicted rpg to a tool specification for the downhole motor.

11. The method of claim 1, further comprising predicting one or more operational parameter values for the downhole motor based on the flowrate-independent power curve.

12. The method of claim 11, wherein the one or more predicted operational parameter values includes one or more of a predicted SWOB, a predicted rate of penetration (ROP), a predicted surface torque (STOR), or a predicted RPM associated with the operation of the downhole motor.

13. The method of claim 12, further including validating the flowrate-independent power curve based on comparing the one or more predicted operational parameter values to one or more measured operational parameter values for the downhole motor.

14. The method of claim 1, wherein the flowrate-independent power law model is characterized by a torque equation:

$$T = \beta \Delta P_a - \gamma \Delta P_a^2$$

where T is torque, $\Delta P_\alpha$ is a total active differential pressure across the downhole motor, $\beta$ is a positive coefficient, and $\gamma$ is a positive coefficient, where $\beta$->$\gamma$, and generating the flowrate-independent power curve includes solving the torque equation for $\beta$ and $\gamma$ using the set of downhole data at the first flowrate.

15. A system, comprising:

at least one processor;

memory in electronic communication with the at least one processor; and instructions stored in the memory, the instructions being executable by the at least one processor to:

receive a set of downhole data associated with an operation of a downhole motor at a first flowrate;

generate a flowrate-independent power curve for the downhole motor using the set of downhole data by fitting a flowrate-independent power law model to the set of downhole data and solving the flowrate-independent power law model for model parameters of the flowrate-independent power law model at the first flowrate;

generate, using the flowrate-independent power curve, new operational parameters for the downhole motor to transition to a new flowrate by solving the flowrate-independent power law model for the new operational parameters at the new flowrate; and provide instructions to the downhole motor to adjust the downhole motor to the new generated operational parameters to operate at the new flowrate.

16. The system of claim 15, wherein the flowrate-independent power curve indicates a flowrate-independent RPM of the downhole motor with respect to a flowrate-independent differential pressure of the downhole motor.

17. The system of claim 15, wherein providing the instructions to the downhole motor includes providing the instructions to cause the downhole motor to operate at a second flowrate that is different from the first flowrate based on the flowrate-independent power curve.

18. A non-transitory computer-readable storage medium including instruction that, when executed by at least one processor, causes the processor to:

receive a set of downhole data associated with an operation of a downhole motor at a first flowrate;

generate a flowrate-independent power curve for the downhole motor using the set of downhole data by fitting a flowrate-independent power law model to the set of downhole data and solving the flowrate-independent power law model for model parameters of the flowrate-independent power law model at the first flowrate;

generate, using the flowrate-independent power curve, new operational parameters for the downhole motor to transition to a new flowrate by solving the flowrate-independent power law model for the new operational parameters at the new flowrate; and adjust the downhole motor to the new generated operational parameters to operate at the new flowrate.

19. The non-transitory computer-readable storage medium of claim 18, wherein the flowrate-independent power curve indicates a flowrate-independent RPM of the downhole motor with respect to a flowrate-independent differential pressure of the downhole motor.

20. The non-transitory computer-readable storage medium of claim 18, further comprising, based on the flowrate-independent power curve, determining a second set of downhole data associated with the operation of the downhole motor at a second flowrate, wherein the new operational parameters are based on the second set of downhole data.

* * * * *